US009458849B2

(12) United States Patent
Sekiya et al.

(10) Patent No.: US 9,458,849 B2
(45) Date of Patent: Oct. 4, 2016

(54) VANE COMPRESSOR THAT SUPPRESSES THE WEAR AT THE TIP OF THE VANE

(75) Inventors: Shin Sekiya, Chiyoda-ku (JP); Raito Kawamura, Chiyoda-ku (JP); Hideaki Maeyama, Chiyoda-ku (JP); Shinichi Takahashi, Chiyoda-ku (JP); Tatsuya Sasaki, Chiyoda-ku (JP); Kanichiro Sugiura, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 118 days.

(21) Appl. No.: 14/350,937

(22) PCT Filed: Jan. 11, 2012

(86) PCT No.: PCT/JP2012/000114

§ 371 (c)(1),
(2), (4) Date: Apr. 10, 2014

(87) PCT Pub. No.: WO2013/105131

PCT Pub. Date: Jul. 18, 2013

(65) Prior Publication Data

US 2014/0294642 A1 Oct. 2, 2014

(51) Int. Cl.
*F03C 2/00* (2006.01)
*F03C 4/00* (2006.01)
(Continued)

(52) U.S. Cl.
CPC ..... *F04C 18/08* (2013.01); *F01C 21/0809* (2013.01); *F01C 21/0836* (2013.01); *F04C 18/321* (2013.01); *F04C 18/3441* (2013.01);
(Continued)

(58) Field of Classification Search
CPC .... F04C 2/344; F04C 2/3446; F04C 18/321; F04C 18/344; F04C 18/3441; F04C 18/352; F04C 29/02; F04C 29/023; F04C 29/025; F04C 29/12; F04C 2240/63; F04C 2240/809; F04C 2240/603; F01C 21/0809; F01C 21/0818; F01C 21/0836
USPC ..... 418/82, 88, 93, 94, 136–137, 145, 148, 418/241, 259
See application file for complete search history.

(56) References Cited

U.S. PATENT DOCUMENTS 1,291,618 A 1/1919 Olson
1,339,723 A 5/1920 Smith
(Continued)

FOREIGN PATENT DOCUMENTS

AU 591068 B2 11/1989
CH 181039 A 11/1935
(Continued)

OTHER PUBLICATIONS

U.S. Appl. No. 14/350,998, filed Apr. 10, 2014, Sekiya, et al.
(Continued)

*Primary Examiner* — Theresa Trieu
(74) *Attorney, Agent, or Firm* — Oblon, McClelland, Maier & Neustadt, L.L.P.

(57) ABSTRACT

A gap between a vane tip and a cylinder inner circumferential surface is denoted by δ. If rv is set as in an Expression (1), a first vane rotates with the vane tip thereof being out of contact with the cylinder inner circumferential surface. In the vane compressor, wear at the tip of a vane is suppressed, loss due to sliding on bearings is reduced by supporting a rotating shaft portion with a small diameter, and accuracy in an outside diameter and center of rotation of a rotor portion is increased.

6 Claims, 12 Drawing Sheets

(51) Int. Cl.

| | |
|---|---|
| ***F04C 2/00*** | (2006.01) |
| ***F04C 18/08*** | (2006.01) |
| ***F04C 18/344*** | (2006.01) |
| ***F04C 29/02*** | (2006.01) |
| ***F01C 21/08*** | (2006.01) |
| ***F04C 18/32*** | (2006.01) |
| ***F04C 18/352*** | (2006.01) |
| *F04C 23/00* | (2006.01) |

(52) U.S. Cl.
CPC ..... *F04C 18/352* (2013.01); *F04C 29/025* (2013.01); *F04C 23/008* (2013.01); *F04C 2240/603* (2013.01); *F04C 2240/809* (2013.01)

(56) References Cited

U.S. PATENT DOCUMENTS

| | | | |
|---|---|---|---|
| 1,444,269 | A | 2/1923 | Piatt |
| 2,044,873 | A | 6/1936 | Beust |
| 4,955,985 | A | 9/1990 | Sakamaki et al. |
| 4,958,995 | A | 9/1990 | Sakamaki et al. |
| 4,997,351 | A | 3/1991 | Sakamaki et al. |
| 4,997,353 | A | 3/1991 | Sakamaki et al. |
| 4,998,867 | A | 3/1991 | Sakamaki et al. |
| 4,998,868 | A | 3/1991 | Sakamaki et al. |
| 5,002,473 | A | 3/1991 | Sakamaki et al. |
| 5,011,390 | A | 4/1991 | Sakamaki et al. |
| 5,022,842 | A | 6/1991 | Sakamari et al. |
| 5,030,074 | A | 7/1991 | Sakamaki et al. |
| 5,032,070 | A | 7/1991 | Sakamaki et al. |
| 5,033,946 | A | 7/1991 | Sakamaki et al. |
| 5,044,910 | A | 9/1991 | Sakamaki et al. |
| 5,087,183 | A | 2/1992 | Edwards |
| 5,536,153 | A | 7/1996 | Edwards |
| 6,193,906 | B1 | 2/2001 | Kaneko et al. |
| 6,223,554 | B1 | 5/2001 | Adachi |
| 8,602,760 | B2 | 12/2013 | Maeyama et al. |
| 2006/0204392 | A1 | 9/2006 | Sharudenko et al. |
| 2013/0064705 | A1 | 3/2013 | Sekiya et al. |

FOREIGN PATENT DOCUMENTS

| | | | | |
|---|---|---|---|---|
| DE | 874 944 | C | | 4/1953 |
| EP | 1 666 707 | A1 | | 6/2006 |
| EP | 2 607 702 | A1 | | 6/2013 |
| GB | 26718 | A | | 0/1910 |
| GB | 244181 | A | | 12/1925 |
| JP | 51-128704 | A | | 11/1976 |
| JP | 52-60911 | A | | 5/1977 |
| JP | 52 47571 | | | 12/1977 |
| JP | 53 8809 | | | 1/1978 |
| JP | 56-29001 | A | | 3/1981 |
| JP | 58 70087 | | | 4/1983 |
| JP | 61 132793 | | | 6/1986 |
| JP | 63-73593 | U | | 5/1988 |
| JP | 63-131883 | A | | 6/1988 |
| JP | 4 187887 | | | 7/1992 |
| JP | 5-133367 | A | | 5/1993 |
| JP | 6-501758 | A | | 2/1994 |
| JP | 8-247063 | A | | 9/1996 |
| JP | 8-247064 | A | | 9/1996 |
| JP | 10 252675 | | | 9/1998 |
| JP | 2000 352390 | | | 12/2000 |
| JP | 2009062820 | A | * | 3/2009 ..... F04C 29/02 |
| WO | WO 96/00852 | A1 | | 1/1996 |
| WO | WO 2010/150816 | A1 | | 12/2010 |

OTHER PUBLICATIONS

U.S. Appl. No. 14/350,989, filed Apr. 10, 2014, Sekiya, et al.
U.S. Appl. No. 14/350,959, filed Apr. 10, 2014, Sekiya, et al.
International Search Report and Written Opinion issued Jul. 2, 2013 in PCT/JP2013/059582 (with English translation of categories of cited documents).
Office Action issued Oct. 29, 2013 in Japanese Patent Application No. 2012-529553 (with English language translation).
Extended European Search Report issued Jun. 17, 2014 in Patent Application No. 11818068.6.
Extended European Search Report issued Jun. 17, 2014 in Patent Application No. 11818070.2.
Office Action mailed Aug. 14, 2014 in co-pending U.S. Appl. No. 13/700,634.
Office Action issued Sep. 30, 2014 in Japanese Patent Application No. 2012-002807 (with English language translation).
Office Action issued Sep. 30, 2014 in Japanese Patent Application No. 2012-003556 (with English language translation).
International Search Report Issued Apr. 10, 2012 in PCT/JP12/000114 Filed Jan. 11, 2012.
Extended European Search Report issued Sep. 21, 2015 in Patent Application No. 12865406.8.

* cited by examiner

B: VANE LONGITUDINAL DIRECTION OF VANE 5a, 6a
C: LINE NORMAL TO ARC AT VANE TIP 5b, 6b

VANE COMPRESSOR THAT SUPPRESSES THE WEAR AT THE TIP OF THE VANE

TECHNICAL FIELD

The present invention relates to a vane compressor.

BACKGROUND ART

Typical vane compressors have hitherto been proposed in each of which a rotor portion included in a rotor shaft (a unit including the rotor portion, which has a columnar shape and undergoes a rotational motion in a cylinder, and a shaft that transmits a rotational force to the rotor portion is referred to as rotor shaft) has one or a plurality of vane grooves in which vanes are fitted, respectively, the tips of the vanes being in contact with and sliding on the inner circumferential surface of the cylinder (see Patent Literature 1, for example).

Another proposed vane compressor includes a rotor shaft having a hollow thereinside. A fixed shaft provided for vanes is provided in the hollow. The vanes are rotatably attached to the fixed shaft. Furthermore, the vanes are each held between a pair of nipping members (a bush) provided near the outer circumference of the rotor portion, the vanes being held in such a manner as to be rotatable with respect to a rotor portion, the nipping members each having a semicircular rod-like shape (see Patent Literature 2, for example).

CITATION LIST

Patent Literature

Patent Literature 1: Japanese Unexamined Patent Application Publication No. 10-252675 (p. 4 and FIG. 1)

Patent Literature 2: Japanese Unexamined Patent Application Publication No. 2000-352390 (p. 6 and FIG. 1)

SUMMARY OF INVENTION

Technical Problem

In the known typical vane compressor disclosed by Patent Literature 1, there is a large difference between the radius of curvature at the tip of each vane and the radius of curvature of the inner circumferential surface of the cylinder. Therefore, no oil film is formed between the inner circumferential surface of the cylinder and the tip of the vane, producing a state of boundary lubrication instead of hydrodynamic lubrication. In general, the coefficient of friction, which depends on the state of lubrication, is about 0.001 to 0.005 in the case of hydrodynamic lubrication but is much higher, about 0.05 or above, in the case of boundary lubrication.

Hence, the configuration of the known typical vane compressor has a problem in that a significant reduction in the compressor efficiency due to an increase in mechanical loss occurs with an increase in the sliding resistance between the tip of the vane and the inner circumferential surface of the cylinder that slide on each other in a state of boundary lubrication. Moreover, the known typical vane compressor has another problem in that the tip of the vane and the inner circumferential surface of the cylinder are liable to wear, making it difficult to provide a long life.

To ease the above problems, a technology has been proposed in which a rotor portion having a hollow thereinside includes a fixed shaft that is provided in the hollow and supports vanes such that the vanes are rotatable about the center of the inner circumferential surface of a cylinder, the vanes being held between nipping members in such a manner as to be rotatable with respect to the rotor portion, the nipping members being provided near the outer circumference of the rotor portion (see Patent Literature 2, for example).

In the above configuration, the vanes are rotatably supported at the center of the inner circumferential surface of the cylinder. Hence, the longitudinal direction of each of the vanes always corresponds to a direction toward the center of the inner circumferential surface of the cylinder. Accordingly, the vanes rotate with the tips thereof moving along the inner circumferential surface of the cylinder. Therefore, a very small gap is always provided between the tip of each of the vanes and the inner circumferential surface of the cylinder, allowing the vanes and the cylinder to behave without coming into contact with each other. Hence, no loss due to sliding at the tips of the vanes occurs. Thus, a vane compressor in which the tips of vanes and the inner circumferential surface of a cylinder do not wear is provided.

In the technology disclosed by Patent Literature 2, however, since the rotor portion has a hollow thereinside, it is difficult to provide a rotational force to the rotor portion and to rotatably support the rotor portion. According to Patent Literature 2, end plates are provided on two respective end facets of the rotor portion. One of the end plates has a disc-like shape out of the need for transmitting power from a rotating shaft. The rotating shaft is connected to the center of the end plate. The other end plate needs to have a ring shape having a hole in a central part thereof out of the need for avoiding the interference with the area of rotation of the fixed shaft having the vanes or a vane-shaft-supporting member. Therefore, a section that rotatably supports the end plate needs to have a larger diameter than the rotating shaft, leading to a problem of an increase in the loss due to sliding on bearings.

Moreover, since a small gap is provided between the rotor portion and the inner circumferential surface of the cylinder so as to prevent the leakage of a gas that has been compressed, the outside diameter and the center of rotation of the rotor portion need to be defined with high accuracy. Despite such circumstances, since the rotor portion and the end plates are provided as separate components, another problem arises in that the accuracy in the outside diameter and the center of rotation of the rotor portion may be deteriorated by any distortion, misalignment, or the like between the rotor portion and the end plates that may occur when they are connected to each other.

The present invention is to solve the above problems and to provide a vane compressor in which the wear at the tip of the vane is suppressed, the loss due to sliding on bearings is reduced by supporting a rotating shaft portion with a small diameter, and the accuracy in the outside diameter and the center of rotation of a rotor portion is increased.

Solution to Problem

A vane compressor according to the present invention includes a compressing element that compresses a refrigerant. The compressing element includes a cylinder having a cylindrical inner circumferential surface, a rotor shaft provided in the cylinder and including a cylindrical rotor portion and a rotating shaft portion, the rotor portion being configured to rotate about an axis of rotation displaced from a central axis of the inner circumferential surface by a predetermined distance, the rotating shaft portion being configured to transmit a rotational force from an outside to the rotor portion, a frame that closes one of openings defined by the inner circumferential surface of the cylinder and supports the rotating shaft portion by a main bearing section thereof, a cylinder head that closes other of the openings defined by the inner circumferential surface of the cylinder and supports the rotating shaft portion by a main bearing section thereof, and at least one vane provided in the rotor portion, the at least one vane having a tip projects from the rotor portion and having a shape of an arc that is convex outward. The vane compressor further includes vane supporting means that supports the vane such that the refrigerant is compressed in a space defined by the vane, an outer circumference of the rotor portion, and the inner circumference of the cylinder and such that a line normal to the arc at the tip of the vane and a line normal to the inner circumferential surface of the cylinder always substantially coincide with each other, the vane supporting means supporting the vane such that the vane is swingable and movable with respect to the rotor portion, the vane supporting means holding the vane such that a predetermined gap is provided between the tip of the vane and the inner circumferential surface of the cylinder in a state where the tip has moved by a maximum length toward the inner circumferential surface of the cylinder. The vane compressor further includes a stopper provided in the recess of the frame and/or the cylinder head and preventing a corresponding one of the vane aligners from moving toward an inner side of the rotor portion. The rotor shaft is an integral body including the rotor portion and the rotating shaft portion. The vane includes a pair of vane aligners each shaped as a part of a ring, one of the vane aligners being provided on an end facet of the vane that is on a side nearer to the frame and on a part of the end facet that is nearer to a center of the rotor portion, the other vane aligner being provided on an end facet of the vane that is on a side nearer to the cylinder head and on a part of the end facet that is nearer to the center of the rotor portion. The frame and the cylinder head each have a recess provided in an end facet thereof that is nearer to the cylinder, the recess being concentric with respect to the inner circumferential surface of the cylinder. The vane aligners are fitted in the recess and are supported by a vane aligner bearing section provided as an outer circumferential surface of the recess.

Advantageous Effects of Invention

According to the present invention, providing a predetermined appropriate gap between the tip of the vane and the cylinder inner circumferential surface suppresses the leakage of the refrigerant at the tip, the reduction in the compressor efficiency due to an increase in the mechanical loss, and the wear of the tip. Furthermore, a mechanism that allows the vane necessary for performing the compressing operation to rotate about the center of the cylinder inner circumferential surface such that the line normal to the arc at the tip of the vane and the line normal to the cylinder inner circumferential surface always substantially coincide with each other is provided as an integral body including the rotor portion and the rotating shaft portion. Hence, the rotating shaft portion can be supported with a small diameter. Accordingly, the loss due to sliding on the bearings is reduced, the accuracy in the outside diameter and the center of rotation of the rotor portion is increased, and the loss due to leakage is reduced with a reduced gap provided between the rotor portion and the cylinder inner circumferential surface.

DESCRIPTION OF EMBODIMENTS

Embodiment 1

(Configuration of Vane Compressor 200)

Figure 1:
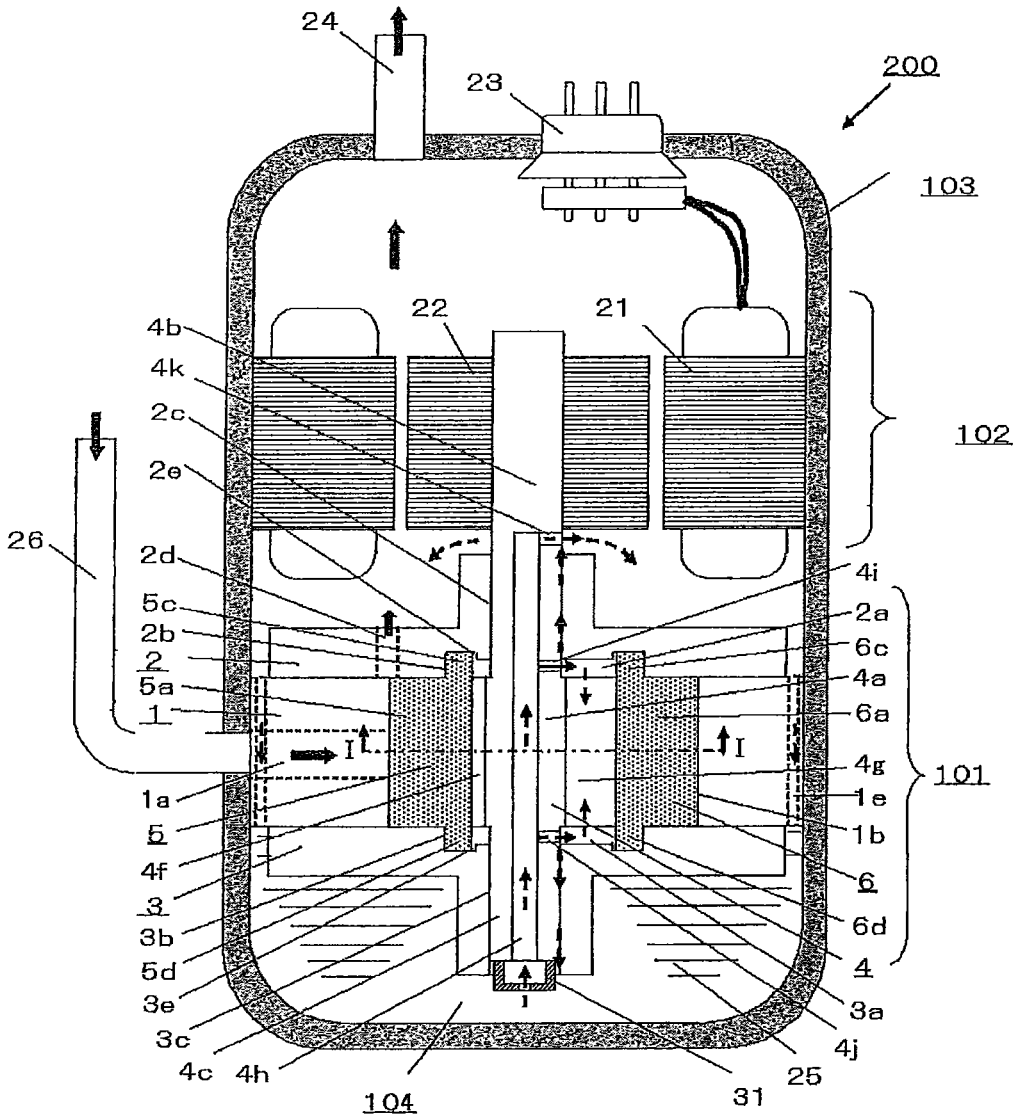
FIG. 1 is a longitudinal sectional view of a vane compressor 200 according to Embodiment 1 of the present invention.
Figure 2:
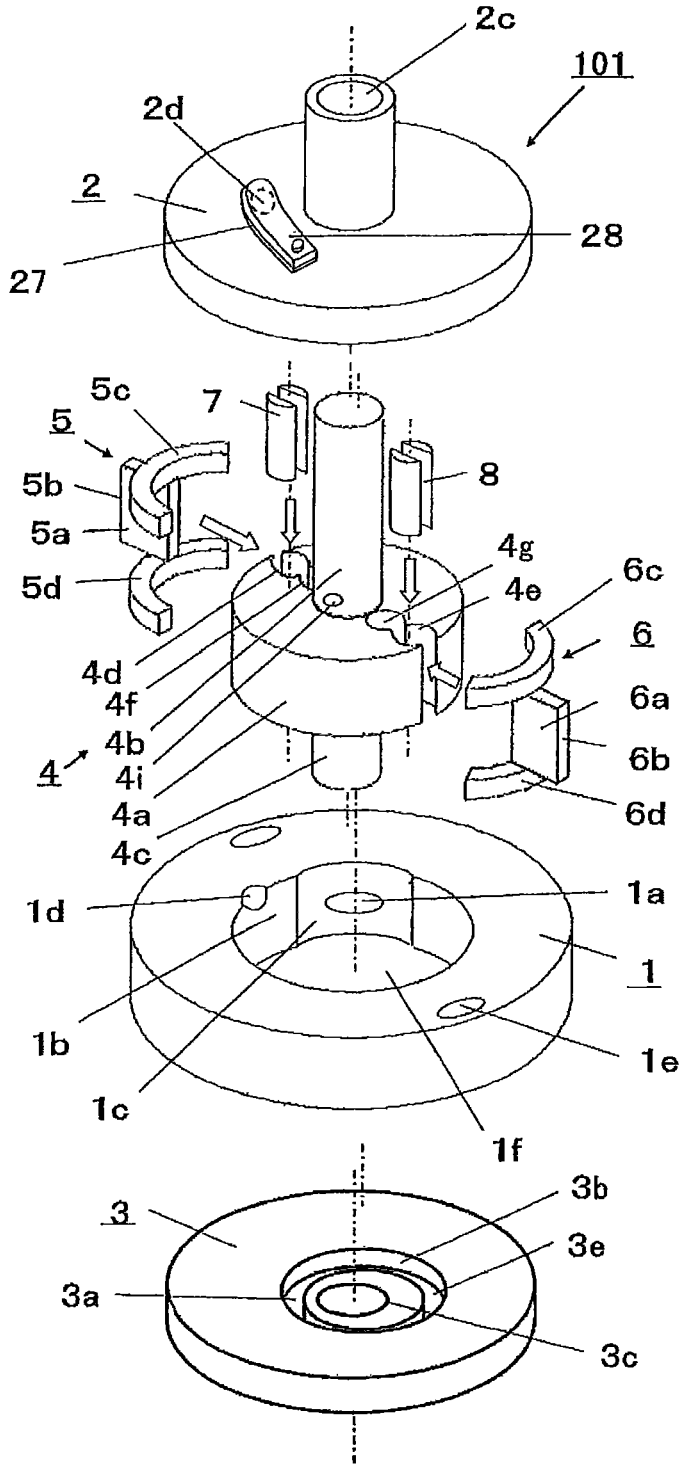
FIG. 2 is an exploded perspective view of a compressing element 101 included in the vane compressor 200 according to Embodiment 1 of the present invention.
Figure 3:
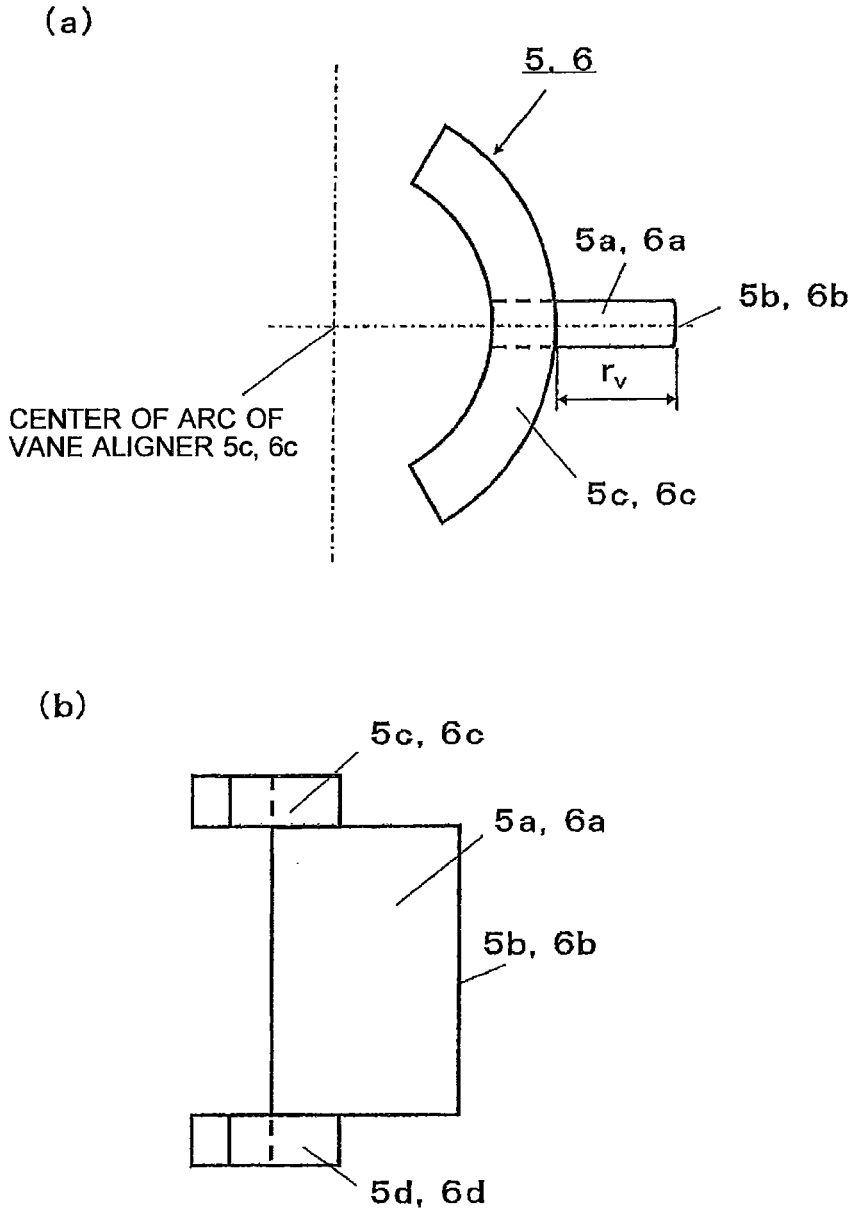
FIG. 3(*a*) and FIG. 3(*b*) include a plan view and a front view each illustrating a first vane 5 and a second vane 6 included in the vane compressor 200 according to Embodiment 1 of the present invention.
Figure 4:
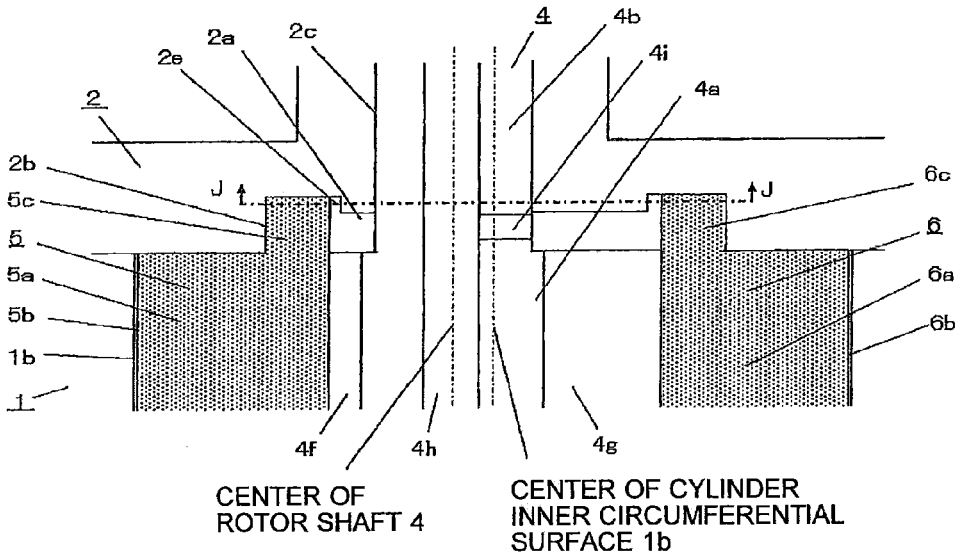
FIG. 4 is a longitudinal sectional view illustrating a vane aligner bearing section 2*b* and associated elements included in the vane compressor 200 according to Embodiment 1 of the present invention.

FIG. 1 is a longitudinal sectional view of a vane compressor 200 according to Embodiment 1 of the present invention. FIG. 2 is an exploded perspective view of a compressing element 101 included in the vane compressor 200. FIG. 3 includes a plan view and a front view each illustrating a first vane 5 and a second vane 6 included in the vane compressor 200. FIG. 4 is a longitudinal sectional view illustrating a vane aligner bearing section 2*b* and associated elements included in the vane compressor 200. In FIG. 1, solid-line arrows represent the flow of a gas (refrigerant), and broken-line arrows represent the flow of a refrigerating machine oil 25. Referring to FIGS. 1 to 4, a configuration of the vane compressor 200 will now be described.

The vane compressor 200 according to Embodiment 1 includes a sealing container 103 that defines the outer shape thereof, the compressing element 101 that is housed in the sealing container 103, an electrical element 102 that is provided above the compressing element 101 and drives the compressing element 101, and an oil sump 104 that is provided in and at the bottom of the sealing container 103 and stores a refrigerating machine oil 25.

The sealing container 103 defines the outer shape of the vane compressor 200 and houses the compressing element 101 and the electrical element 102 thereinside. The sealing container 103 stores the refrigerant and the refrigerating machine oil in a tight manner. A suction pipe 26 through which the refrigerant is sucked into the sealing container 103 is provided on a side face of the sealing container 103. A discharge pipe 24 through which the refrigerant that has been compressed is discharged to the outside is provided on the top face of the sealing container 103.

The compressing element 101 compresses the refrigerant that has been sucked into the sealing container 103 via the suction pipe 26 and includes a cylinder 1, a frame 2, a cylinder head 3, a rotor shaft 4, the first vane 5, the second vane 6, and bushes 7 and 8.

The cylinder 1 has a substantially cylindrical shape in its entirety and has a through section 1*f* having a substantially circular shape and being axially eccentric in the axial direction with respect to a circle defined by the cylindrical shape. A part of a cylinder inner circumferential surface 1*b* forming the inner circumferential surface that defines the through section 1*f* is recessed in a direction from the center of the through section 1*f* toward the outer side and in a curved shape, whereby a notch 1*c* is provided. The notch 1*c* has a suction port 1*a*. The suction port 1*a* communicates with the suction pipe 26. The refrigerant is sucked into the through section 1*f* via the suction port 1*a*. A discharge port 1*d* in the form of a notch is provided across a closest point 32, to be described below, from the suction port 1*a* and near the closest point 32. The discharge port 1*d* is provided on a side of the cylinder 1 facing the frame 2, to be described below (see FIG. 2). The cylinder 1 has two oil return holes 1*e* provided in an outer periphery thereof and extending therethrough in the axial direction. The oil return holes 1*e* are provided at respective positions that are symmetrical to each other with respect to the center of the through section 1*f*.

The frame 2 has a substantially T-shaped vertical section. A part of the frame 2 that is in contact with the cylinder 1 has a substantially disc-like shape. The frame 2 closes one of the openings (the upper one in FIG. 2) at the through section if provided in the cylinder 1. The frame 2 has a cylindrical section in a central part thereof. The cylindrical section is hollow, thereby forming a main bearing section 2*c*. A recess 2*a* is provided in an end facet of the frame 2 that is nearer to the cylinder 1 and in a part corresponding to the main bearing section 2*c*. The outer circumferential surface of the recess 2*a* forms a circle concentric with respect to the cylinder inner circumferential surface 1*b*. The recess 2*a* has a level difference between an outer circumferential side thereof and an inner circumferential side thereof. An annular groove 2*e* that is recessed with a larger depth is provided on the outer circumferential side of the recess 2*a*. A vane aligner 5*c* of the first vane 5 and a vane aligner 6*c* of the second vane 6, to be described below, are fitted in the groove 2*e*. The vane aligners 5*c* and 6*c* are supported by a vane aligner bearing section 2*b* provided by the outer circumferential surface of the recess 2*a*. The frame 2 also has a discharge port 2*d* communicating with the discharge port 1*d* provided in the cylinder 1 and extending through the frame 2 in the axial direction. A discharge valve 27 and a discharge valve guide 28 that regulates the opening degree of the discharge valve 27 are attached to one of the openings at the discharge port 2*d* that is farther from the cylinder 1.

The cylinder head 3 has a substantially T-shaped vertical section. A part of the cylinder head 3 that is in contact with the cylinder 1 has a substantially disc-like shape. The cylinder head 3 closes the other one of the openings (the lower one in FIG. 2) at the through section 1*f* of the cylinder 1. The cylinder head 3 has a cylindrical section in a central part thereof. The cylindrical section is hollow, thereby forming a main bearing section 3*c*. A recess 3*a* is provided in an end facet of the cylinder head 3 that is nearer to the cylinder 1 and in a part corresponding to the main bearing section 3*c*. The outer circumferential surface of the recess 3*a* forms a circle concentric with respect to the cylinder inner circumferential surface 1*b*. The recess 3*a* has a level difference between an outer circumferential side thereof and an inner circumferential side thereof. An annular groove 3*e* that is recessed with a larger depth is provided on the outer circumferential side of the recess 3*a*. A vane aligner 5*d* of the first vane 5 and a vane aligner 6*d* of the second vane 6, to be described below, are fitted in the groove 3*e*. The vane aligners 5*d* and 6*d* are supported by a vane aligner bearing section 3*b* provided by the outer circumferential surface of the recess 3*a*.

The rotor shaft 4 is an integral body including a substantially cylindrical rotor portion 4*a* that is provided in the cylinder 1 and undergoes a rotational motion about a central axis that is eccentric with respect to the central axis of the through section 1*f* of the cylinder 1, a rotating shaft portion 4*b* that extends perpendicularly upward from the center of a circular upper surface of the rotor portion 4*a*, and a rotating shaft portion 4*c* that extends perpendicularly downward from the center of a circular lower surface of the rotor portion 4*a*. The rotating shaft portion 4*b* extends through and is supported by the main bearing section 2*c* of the frame 2. The rotating shaft portion 4*c* extends through and is supported by the main bearing section 3*c* of the cylinder head 3. The rotor portion 4*a* includes bush holding sections 4*d* and 4*e* and vane relief sections 4*f* and 4*g* each extending through the rotor portion 4*a*, having a cylindrical shape, in the axial direction of the rotor portion 4*a* and having a substantially circular sectional shape in a direction perpendicular to the axial direction. The bush holding sections 4*d* and 4*e* are provided at respective positions that are symmetrical to the rotor portion 4*a*. The vane relief sections 4*f* and 4*g* are provided on the inner side of the respective bush holding sections 4*d* and 4*e*. That is, the centers of the rotor portion 4*a*, the bush holding sections 4*d* and 4*e*, and the vane relief sections 4*f* and 4*g* are aligned substantially linearly. Furthermore, the bush holding section 4*d* and the vane relief section 4*f* communicate with each other, and the bush holding section 4*e* and the vane relief section 4*g* communicate with each other. Furthermore, the axial ends of each of the vane relief sections 4*f* and 4*g* communicate with the recess 2*a* of the frame 2 and the recess 3*a* of the cylinder head 3, respectively. Furthermore, an oil pump 31 that utilizes the centrifugal force of the rotor shaft 4, such as that disclosed by, for example, Japanese Unexamined Patent Application Publication No. 2009-62820, is provided at the lower end of the rotating shaft portion 4*c* of the rotor shaft 4. The oil pump 31 at the lower end resides in an axially central part of the rotating shaft portion 4*c* of the rotor shaft 4 and communicates with an oil supply path 4*h* extending upward from the lower end of the rotating shaft portion 4*c* through the rotor portion 4*a* up to a position in the rotating shaft portion 4*b*. The rotating shaft portion 4*b* has an oil supply path 4*i* that allows the oil supply path 4*h* and the recess 2*a* to communicate with each other. The rotating shaft portion 4*c* has an oil supply path 4*j* that allows the oil supply path 4*h* and the recess 3*a* to communicate with each other. Furthermore, the rotating shaft portion 4*b* has a waist oil hole 4*k* at a position thereof above the main bearing section 2*c*. The waist oil hole 4*k* allows the oil supply path 4*h* to communicate with the internal space of the sealing container 103.

The first vane 5 includes a vane 5*a* that is a substantially rectangular plate-like member; the vane aligner 5*c* provided on the upper end facet of the vane 5*a* that is nearer to the frame 2 and the rotating shaft portion 4*b*, the vane aligner 5*c* having an arc shape, that is, shaped as a part of a ring; and the vane aligner 5*d* provided on the lower end facet of the vane 5*a* that is nearer to the cylinder head 3 and the rotating shaft portion 4*c*, the vane aligner 5*d* having an arc shape, that is, shaped as a part of a ring. A vane tip 5*b* as an end facet of the vane 5*a* that is nearer to the cylinder inner circumferential surface 1*b* has an arc shape that is convex outward. The radius of curvature of the arc is substantially same as the radius of curvature of the cylinder inner circumferential surface 1*b*. As illustrated in FIG. 3(*a*), the first vane 5 is configured such that a line that is normal to the arc at the vane tip 5*b* and that extends in the longitudinal direction of the vane 5*a* passes through the center of the arc of each of the vane aligners 5*c* and 5*d*. As illustrated in FIG. 4, the width of the vane aligner 5*c* in a direction of the radius of the arc is smaller than the groove width of the groove 2*e* of the frame 2 in which the vane aligner 5*c* is fitted. Likewise, the width of the vane aligner 5*d* in a direction of the radius of the arc is smaller than the groove width of the groove 3*e* of the cylinder head 3 in which the vane aligner 5*d* is fitted.

The second vane 6 includes a vane 6*a* that is a substantially rectangular plate-like member; the vane aligner 6*c* provided on the upper end facet of the vane 6*a* that is nearer to the frame 2 and the rotating shaft portion 4*b*, the vane aligner 6*c* having an arc shape, that is, shaped as a part of a ring; and the vane aligner 6*d* provided on the lower end facet of the vane 6*a* that is nearer to the cylinder head 3 and the rotating shaft portion 4*c*, the vane aligner 6*d* having an arc shape, that is, shaped as a part of a ring. A vane tip 6*b* as an end facet of the vane 6*a* that is nearer to the cylinder inner circumferential surface 1*b* has an arc shape that is convex outward. The radius of curvature of the arc is substantially the same as the radius of curvature of the cylinder inner circumferential surface 1*b*. As illustrated in FIG. 3(*a*), the second vane 6 is configured such that a line that is normal to the arc at the vane tip 6*b* and that extends in the longitudinal direction of the vane 6*a* passes through the center of the arc of each of the vane aligners 6*c* and 6*d*. As illustrated in FIG. 4, the width of the vane aligner 6*c* in a direction of the radius of the arc is smaller than the groove width of the groove 2*e* of the frame 2 in which the vane aligner 6*c* is fitted. Likewise, the width of the vane aligner 6*d* in a direction of the radius of the arc is smaller than the groove width of the groove 3*e* of the cylinder head 3 in which the vane aligner 6*d* is fitted.

The bushes 7 and 8 each include a pair of members each having a substantially semicircular columnar shape. The bush 7 is fitted in the bush holding section 4*d* of the rotor shaft 4. The vane 5*a* having a plate-like shape is held between the pair of members of the bush 7. In this state, the vane 5*a* is held in such a manner as to be rotatable with respect to the rotor portion 4*a* and movable in the longitudinal direction of the vane 5*a*. The bush 8 is fitted in the bush holding section 4*e* of the rotor shaft 4. The vane 6*a* having a plate-like shape is held between the pair of members of the bush 8. In this state, the vane 6*a* is held in such a manner as to be rotatable with respect to the rotor portion 4*a* and movable in the longitudinal direction of the vane 6*a*.

The bush holding sections 4*d* and 4*e*, the vane relief sections 4*f* and 4*g*, the bushes 7 and 8, and the vane aligner bearing sections 2*b* and 3*b* correspond to "vane supporting means" according to the present invention.

The electrical element 102 is, for example, a brushless DC motor and includes, as illustrated in FIG. 1, a stator 21 fixed to the inner circumference of the sealing container 103, and a rotor 22 provided on the inner side of the stator 21 and including permanent magnets. The stator 21 receives electric power from a glass terminal 23 fixed to the upper surface of the sealing container 103. The electric power drives the rotor 22 to rotate. The rotating shaft portion 4*b* of the rotor shaft 4 extends through and is fixed to the rotor 22. When the rotor 22 rotates, a rotational force of the rotor 22 is transmitted to the rotating shaft portion 4*b*, whereby the entirety of the rotor shaft 4 rotates.

(Compressing Operation of Vane Compressor 200)

Figure 5:
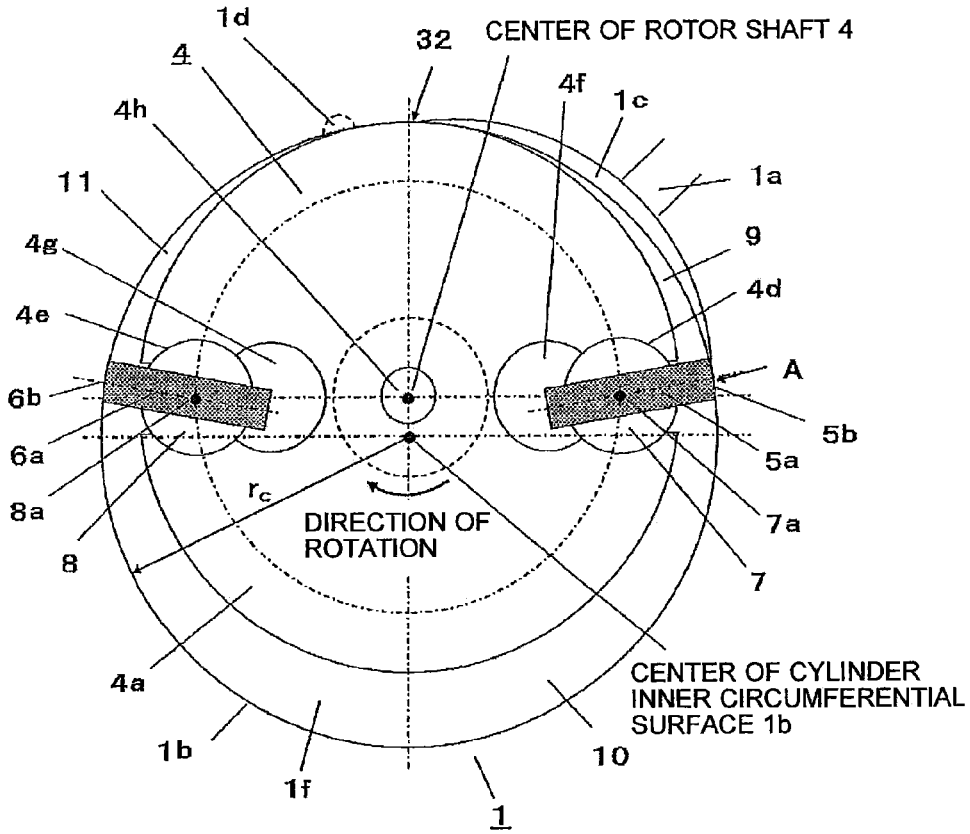
FIG. 5 is a sectional view of the vane compressor 200 according to Embodiment 1 of the present invention that is taken along line I-I illustrated in FIG. 1.
Figure 6:
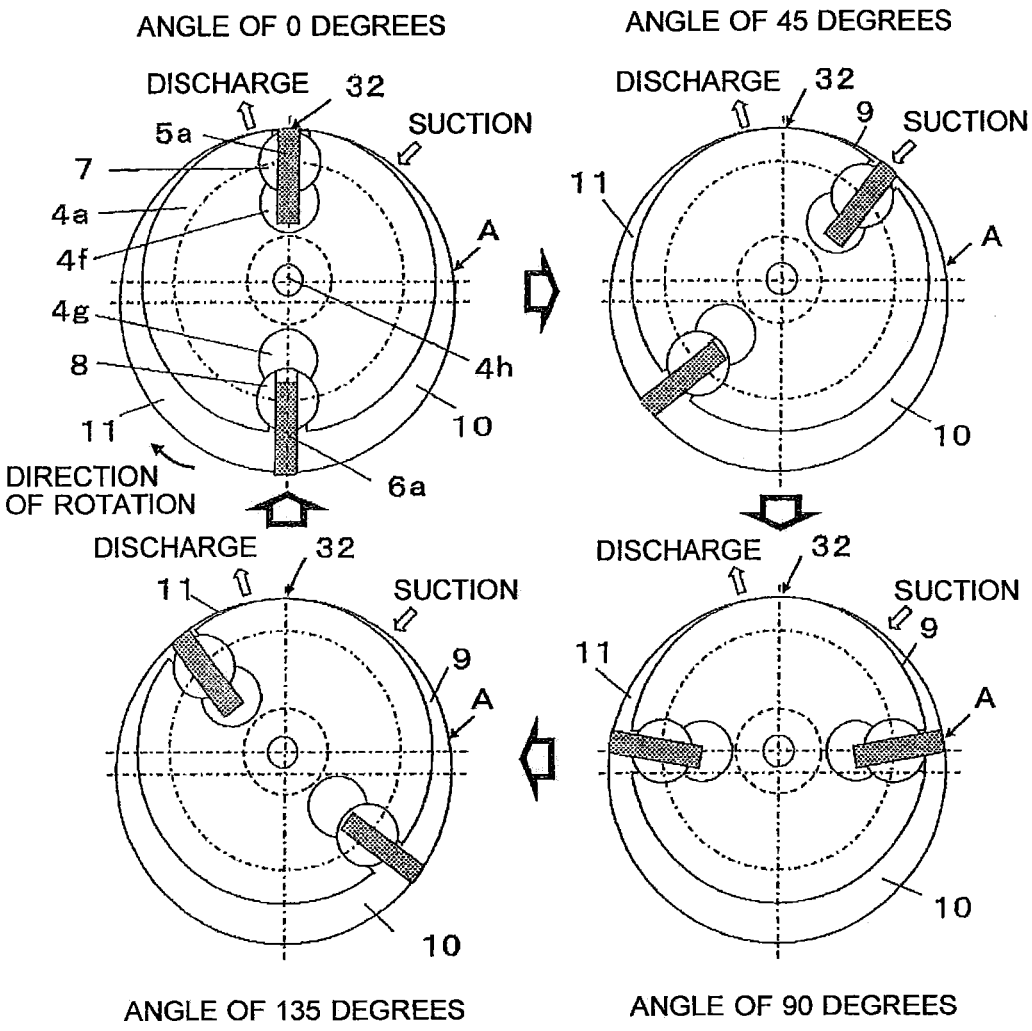
FIG. 6 includes diagrams illustrating a compressing operation performed by the vane compressor 200 according to Embodiment 1 of the present invention.

FIG. 5 is a sectional view of the vane compressor 200 according to Embodiment 1 of the present invention that is taken along line I-I illustrated in FIG. 1. FIG. 6 includes diagrams illustrating a compressing operation performed by the vane compressor 200. Referring to FIGS. 5 and 6, the compressing operation performed by the vane compressor 200 will now be described.

FIG. 5 illustrates a state where the rotor portion 4*a* of the rotor shaft 4 resides nearest to a position (the closest point 32) on the cylinder inner circumferential surface 1*b*. Letting the radius of each of the vane aligner bearing sections 2*b* and 3*b* be ra (see FIG. 7 to be referred to below) and the radius of the cylinder inner circumferential surface 1*b* be rc, a distance rv (see FIG. 3) between the outer circumferential side of each of the vane aligners 5*c* and 5*d* of the first vane 5 and the vane tip 5*b* is expressed by Expression (1) below.

$$ry=rc-ra-\delta \quad (1)$$

Here, δ denotes the gap between the vane tip 5*b* and the cylinder inner circumferential surface 1*b*. If rv is set as in Expression (1), the first vane 5 rotates with the vane tip 5*b* thereof being out of contact with the cylinder inner circumferential surface 1*b*. If rv is set such that δ is minimized, the leakage of the refrigerant at the vane tip 5*b* is minimized. The relationship expressed by Expression (1) also applies to the second vane 6. That is, the second vane 6 rotates while a small gap is provided between the vane tip 6*b* of the second vane 6 and the cylinder inner circumferential surface 1*b*.

In the above configuration, the closest point 32 where the rotor portion 4*a* resides nearest to the cylinder inner circumferential surface 1*b*, the vane tip 5*b* of the first vane 5, and the vane tip 6*b* of the second vane 6 define three spaces (a suction chamber 9, an intermediate chamber 10, and a compression chamber 11) in the through section 1*f* of the cylinder 1. The refrigerant that is sucked from the suction pipe 26 via the suction port 1*a* provided in the notch 1*c* flows into the suction chamber 9. As illustrated in FIG. 5 (the angular position of the rotor shaft 4 illustrated in FIG. 5 is defined as 90 degrees), the notch 1*c* extends from a position near the closest point 32 to a position corresponding to a near point A where the vane tip 5*b* of the first vane 5 and the cylinder inner circumferential surface 1*b* are near each other. The compression chamber 11 communicates with the discharge port 2*d*, provided in the frame 2, via the discharge port 1*d* of the cylinder 1. The discharge port 2*d* is closed by the discharge valve 27 when the refrigerant is not discharged. Hence, the intermediate chamber 10 is a space that communicates with the suction port 1*a* at an angle of rotation of up to 90 degrees but does not communicate with either the suction port 1*a* or the discharge port 1*d* at an angle of rotation of over 90 degrees. At an angle of rotation of over 90 degrees, the intermediate chamber 10 communicates with the discharge port 1*d* and turns into the compression chamber 11. In FIG. 5, bush centers 7*a* and 8*a* are the centers of rotation of the respective bushes 7 and 8 and are also the centers of rotation of the respective vane 5*a* and 6*a*.

Now, a rotational motion of the rotor shaft 4 of the vane compressor 200 will be described.

The rotating shaft portion 4*b* of the rotor shaft 4 receives a rotational force from the rotor 22 of the electrical element 102, whereby the rotor portion 4*a* rotates in the through section 1*f* of the cylinder 1. With the rotation of the rotor portion 4*a*, the bush holding sections 4*d* and 4*e* of the rotor portion 4*a* move on the circumference of a circle that is centered on the rotor shaft 4. Meanwhile, the pair of members included in each of the bushes 7 and 8 that are held by a corresponding one of the bush holding sections 4*d* and 4*e*, and each of the vane 5*a* of the first vane 5 and the vane 6*a* of the second vane 6 that is rotatably held between the pair of members included in a corresponding one of the bushes 7 and 8 also rotate with the rotation of the rotor portion 4*a*. The first vane 5 and the second vane 6 receive a centrifugal force produced by the rotation of the rotor portion 4*a*, whereby the vane aligners 5*c* and 6*c* and the vane aligners 5*d* and 6*d* are pressed against and slide along the respective vane aligner bearing sections 2*b* and 3*b* while rotating about the centers of the respective vane aligner bearing sections 2*b* and 3*b*. Here, since the vane aligner bearing sections 2*b* and 3*b* are concentric with respect to the cylinder inner circumferential surface 1*b*, the first vane 5 and the second vane 6 rotate about the center of the cylinder inner circumferential surface 1*b*. In such a case, the bushes 7 and 8 rotate about the respective bush centers 7*a* and 8*a* in the respective bush holding sections 4*d* and 4*e* such that the center line of longitudinal direction of each of the vane 5*a* of the first vane 5 and the vane 6*a* of the second vane 6 passes through the center of the cylinder inner circumferential surface 1*b*. That is, the rotor portion 4*a* rotates in a state where the line normal to the arc at each of the vane tips 5*b* and 6*b* and the line normal to the cylinder inner circumferential surface 1*b* always substantially coincide with each other.

In the above motion, the bush 7 and the vane 5*a* of the first vane 5 slide on each other by side faces thereof, and the bush 8 and the vane 6*a* of the second vane 6 slide on each other by side faces thereof. Furthermore, the bush holding section 4*d* of the rotor shaft 4 and the bush 7 slide on each other, and the bush holding section 4*e* of the rotor shaft 4 and the bush 8 slide on each other.

Referring now to FIG. 6, how the capacities of the suction chamber 9, the intermediate chamber 10, and the compression chamber 11 change will be described. In FIG. 6, for easier illustration, the suction port 1*a*, the notch 1*c*, and the discharge port 1*d* are not illustrated. Instead, the suction port 1*a* and the discharge port 1*d* are represented by arrows denoted by "suction" and "discharge," respectively. First, with the rotation of the rotor shaft 4, a low-pressure gas refrigerant flows into the suction port 1*a* from the suction pipe 26. Here, in FIG. 6, the angle of rotation at which the closest point 32 where the rotor portion 4*a* of the rotor shaft 4 and the cylinder inner circumferential surface 1*b* are nearest to each other coincides with a position where the vane 5*a* and the cylinder inner circumferential surface 1*b* face each other is defined as "the angle of 0 degrees". FIG. 6 illustrates the positions of the vane 5*a* and the vane 6*a* and the states of the suction chamber 9, the intermediate chamber 10, and the compression chamber 11 at "the angle of 0 degrees," at "the angle of 45 degrees", at "the angle of 90 degrees," and at "the angle of 135 degrees". In the diagram included in FIG. 6 that illustrates the state at "the angle of 0 degrees", the direction of rotation of the rotor shaft 4 (the clockwise direction in FIG. 6) is represented by an arrow. In the other diagrams included in FIG. 5 that illustrate the states at the other angles, the arrow representing the direction of rotation of the rotor shaft 4 is omitted. States at "the angle of 180 degrees" and larger angles are not illustrated because a state that is the same as that at "the angle of 0 degrees" is established at "the angle of 180 degrees" with the first vane 5 and the second vane 6 being interchanged with each other, and, thereafter, the compression operation progresses in the same manner as for the transition from "the angle of 0 degrees" to "the angle of 135 degrees".

At "the angle of 0 degrees" illustrated in FIG. 6, the right one of the spaces defined between the closest point 32 and the vane 6*a* of the second vane 6 is the intermediate chamber 10, which communicates with the suction port 1*a* via the notch 1*c* and into which the gas refrigerant is sucked. The left one of the spaces defined between the closest point 32 and the vane 6*a* of the second vane 6 is the compression chamber 11, which communicates with the discharge port 1*d*.

At "the angle of 45 degrees" illustrated in FIG. 6, a space defined between the vane 5*a* of the first vane 5 and the closest point 32 is the suction chamber 9. The intermediate chamber 10 defined between the vane 5*a* of the first vane 5 and the vane 6*a* of the second vane 6 communicates with the suction port 1*a* via the notch 1*c* and has a capacity increased from that at "the angle of 0 degrees." Therefore, the suction of the gas refrigerant continues. A space defined between the vane 6*a* of the second vane 6 and the closest point 32 is the compression chamber 11. The capacity of the compression chamber 11 is reduced from that at "the angle of 0 degrees." Therefore, the gas refrigerant is compressed, and the pressure thereof gradually increases.

At "the angle of 90 degrees" illustrated in FIG. 6, since the vane tip 5*b* of the first vane 5 reaches the point A on the cylinder inner circumferential surface 1*b*, the intermediate chamber 10 loses communication with the suction port 1*a*. Therefore, the suction of the gas refrigerant into the intermediate chamber 10 ends. In this state, the capacity of the intermediate chamber 10 is substantially largest. The capacity of the compression chamber 11 is further reduced from that at "the angle of 45 degrees," and the pressure of the gas refrigerant increases. The capacity of the suction chamber 9 is increased from that at "the angle of 45 degrees." Therefore, the suction chamber 9 communicates with the suction port 1*a* via the notch 1*c*, and the gas refrigerant is sucked thereinto.

At "the angle of 135 degrees" illustrated in FIG. 6, the capacity of the intermediate chamber 10 is reduced from that at "the angle of 90 degrees," and the pressure of the refrigerant increases. The capacity of the compression chamber 11 is also reduced from that at "the angle of 90 degrees," and the pressure of the refrigerant increases. The capacity of the suction chamber 9 is increased from that at "the angle of 90 degrees." Therefore, the suction of the gas refrigerant continues.

Subsequently, the vane 6*a* of the second vane 6 comes closer to the discharge port 1*d*. When the pressure of the gas refrigerant in the compression chamber 11 exceeds a high pressure in a refrigeration cycle (including a pressure required for opening the discharge valve 27), the discharge valve 27 opens. Then, the gas refrigerant in the compression chamber 11 flows into the discharge port 1*d* and the discharge port 2*d* and is discharged into the sealing container 103 as illustrated in FIG. 1. The gas refrigerant discharged into the sealing container 103 flows through the electrical element 102, the discharge pipe 24 fixed to the upper section of the sealing container 103, and is discharged to the outside (to a high-pressure side of the refrigeration cycle). Accordingly, the inside of the sealing container 103 is at a high pressure corresponding to a discharge pressure.

After the vane 6*a* of the second vane 6 passes the discharge port 1*d*, a small amount of high-pressure gas refrigerant remains (as a loss) in the compression chamber 11. When the compression chamber 11 disappears at "the angle of 180 degrees" (not illustrated), the high-pressure gas refrigerant turns into a low-pressure gas refrigerant in the suction chamber 9. At "the angle of 180 degrees," the suction chamber 9 turns into the intermediate chamber 10, and the intermediate chamber 10 turns into the compression chamber 11. Subsequently, the above compressing operation is repeated.

With the rotation of the rotor portion 4*a* of the rotor shaft 4, the capacity of the suction chamber 9 gradually increases. Therefore, the suction of the gas refrigerant continues. Subsequently, the suction chamber 9 turns into the intermediate chamber 10. Before that (before the vane (the vane 5*a* or the vane 6*a*) that separates the suction chamber 9 and the intermediate chamber 10 from each other reaches the point A), the capacity of the suction chamber 9 gradually increases, and the suction of the gas refrigerant continues further. In this process, the capacity of the intermediate chamber 10 becomes largest, and the intermediate chamber 10 goes out of communication with the suction port 1*a*, whereby the suction of the gas refrigerant ends. Subsequently, the capacity of the intermediate chamber 10 is gradually reduced, whereby the gas refrigerant is compressed. Subsequently, the intermediate chamber 10 turns into the compression chamber 11, and the compression of the gas refrigerant continues. The gas refrigerant that has been compressed to a predetermined pressure flows through the discharge port 1*d* and the discharge port 2*d*, pushes up the discharge valve 27, and is discharged into the sealing container 103.

Figure 7:
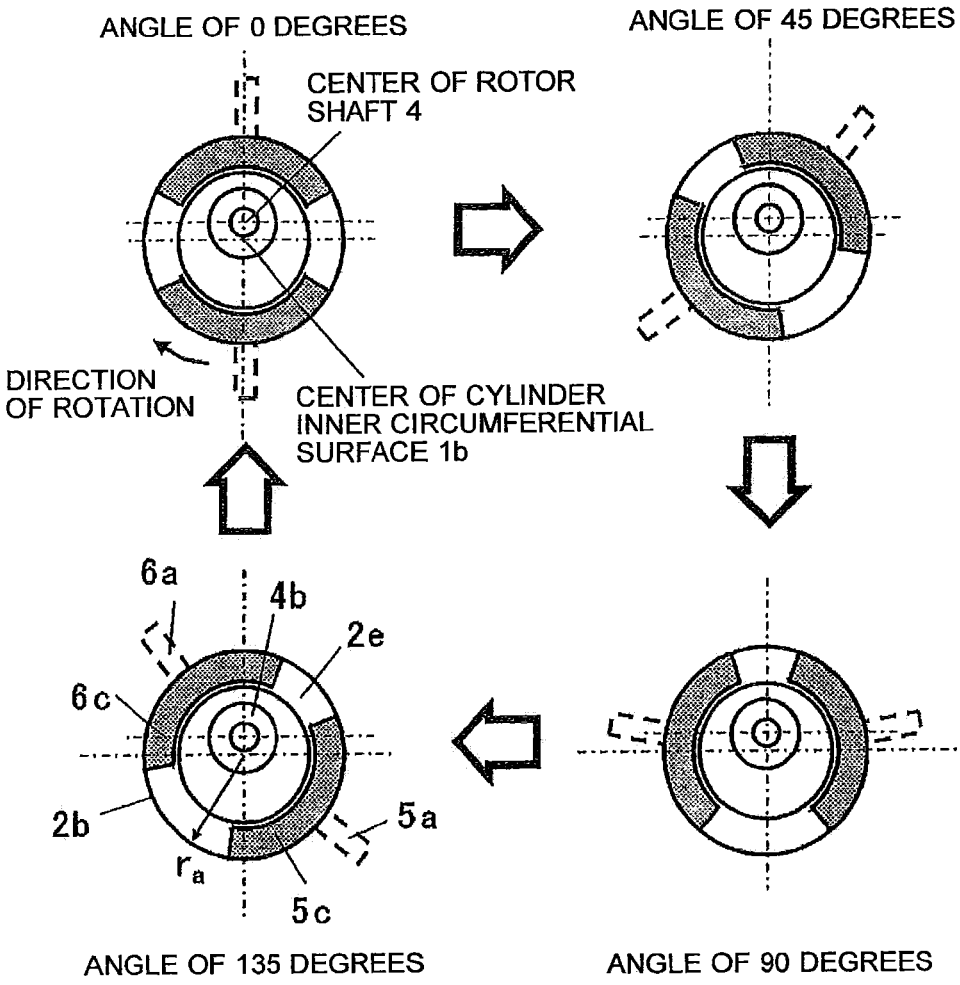
FIG. 7 includes sectional views each taken along line J-J illustrated in FIG. 4 and illustrating rotational motions of vane aligners 5*c* and 6*c* included in the vane compressor 200 according to Embodiment 1 of the present invention.

FIG. 7 includes sectional views each taken along line J-J illustrated in FIG. 4 and illustrating rotational motions of vane aligners 5*c* and 6*c* included in the vane compressor 200 according to Embodiment 1 of the present invention.

In the diagram included in FIG. 7 that illustrates "the angle of 0 degrees," the direction of rotation of the vane aligners 5*c* and 6*c* (the clockwise direction in FIG. 7) is represented by an arrow. In the other diagrams included in FIG. 7 that illustrate the other angles, the arrow representing the direction of rotation of the vane aligners 5*c* and 6*c* is omitted. With the rotation of the rotor shaft 4, the vane 5*a* of the first vane 5 and the vane 6*a* of the second vane 6 rotate about the center of the cylinder inner circumferential surface 1*b*. Hence, as illustrated in FIG. 7, the vane aligners 5*c* and 6*c* supported by the vane aligner bearing section 2*b* rotate in the groove 2*e* provided in the recess 2*a* and about the center of the cylinder inner circumferential surface 1*b*. Likewise, the vane aligners 5*d* and 6*d* supported by the vane aligner bearing section 3*b* rotate in the groove 3*e* provided in the recess 3*a* and about the center of the cylinder inner circumferential surface 1*b*.

(Behavior of Refrigerating Machine Oil 25)

In the above motion, referring to FIG. 1, when the rotor shaft 4 rotates, the refrigerating machine oil 25 is sucked from the oil sump 104 by the oil pump 31 and is fed into the oil supply path 4*h*. The refrigerating machine oil 25 that has been fed into the oil supply path 4*h* is fed into the recess 2*a* of the frame 2 via the oil supply path 4*i* and into the recess 3*a* of the cylinder head 3 via the oil supply path 4*j*. Sections of the refrigerating machine oil 25 that has been fed into the recesses 2*a* and 3*a* are fed into the respective grooves 2*e* and 3*e*, lubricate the respective vane aligner bearing sections 2*b* and 3*b*, and are supplied into the vane relief sections 4*f* and 4*g* that communicate with the recesses 2*a* and 3*a*. In this step, the inside of the sealing container 103 is at a high pressure corresponding to the discharge pressure. Accordingly, the insides of the recesses 2*a* and 3*a* and in the vane relief sections 4*f* and 4*g* are also at the discharge pressure. Other portions of the refrigerating machine oil 25 that have been fed into the recesses 2*a* and 3*a* are supplied to and lubricate the main bearing section 2*c* of the frame 2 and the main bearing section 3*c* of the cylinder head 3, respectively.

Figure 8:
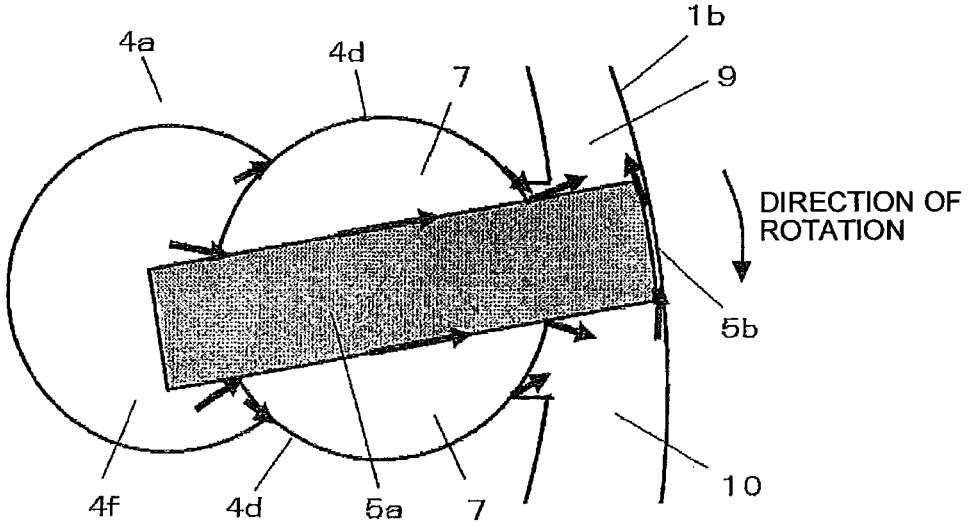
FIG. 8 is a sectional view illustrating a vane 5*a* of the first vane 5 and associated elements included in the vane compressor 200 according to Embodiment 1 of the present invention.

FIG. 8 is a sectional view illustrating a vane 5*a* of the first vane 5 and associated elements included in the vane compressor 200 according to Embodiment 1 of the present invention.

In FIG. 8, the solid-line arrows represent the flow of the refrigerating machine oil 25. The inside of the vane relief section 4*f* is at the discharge pressure that is higher than the pressures in the suction chamber 9 and the intermediate chamber 10. Therefore, the pressure difference and the centrifugal force cause the refrigerating machine oil 25 to be fed into the suction chamber 9 and the intermediate chamber 10 while lubricating sliding sections between the bush 7 and the side faces of the vane 5*a*. The pressure difference and the centrifugal force cause the refrigerating machine oil 25 to also lubricate sliding sections between the bush 7 and the bush holding section 4*d* of the rotor shaft 4 while being fed into the suction chamber 9 and the intermediate chamber 10. A portion of the refrigerating machine oil 25 that has been fed into the intermediate chamber 10 flows into the suction chamber 9 while sealing the gap between the vane tip 5*b* and the cylinder inner circumferential surface 1*b*.

While the above description concerns a situation where the vane 5*a* of the first vane 5 separates the suction chamber 9 and the intermediate chamber 10 from each other, the same applies to a situation established with further rotation of the rotor shaft 4 where the vane 5*a* of the first vane 5 separates the intermediate chamber 10 and the compression chamber 11 from each other. That is, even in a case where the pressure in the compression chamber 11 has reached the discharge pressure that is the same as the pressure in the vane relief section 4*f*, the refrigerating machine oil 25 is fed toward the compression chamber 11 with the centrifugal force.

While the above description concerns the motion of the first vane 5, the same applies to the second vane 6.

As illustrated in FIG. 1, the portion of the refrigerating machine oil 25 that has been supplied to the main bearing section 2*c* flows through the gap between the main bearing section 2*c* and the rotating shaft portion 4*b* and is discharged into the space above the frame 2. Subsequently, the refrigerating machine oil 25 flows through the oil return holes 1*e* provided in the outer periphery of the cylinder 1 and is fed back to the oil sump 104. Meanwhile, the portion of the refrigerating machine oil 25 that has been supplied to the main bearing section 3*c* flows through the gap between the main bearing section 3*c* and the rotating shaft portion 4*c* and is fed back to the oil sump 104. Furthermore, the portions of the refrigerating machine oil 25 that have been fed into the suction chamber 9, the intermediate chamber 10, and the compression chamber 11 via the vane relief sections 4*f* and 4*g* are eventually discharged into the space above the frame 2 via the discharge port 2*d* together with the gas refrigerant and are fed back to the oil sump 104 via the oil return holes 1*e* provided in the outer periphery of the cylinder 1. In the refrigerating machine oil 25 that has been fed into the oil supply path 4*h* by the oil pump 31, an excessive portion of the refrigerating machine oil 25 is discharged into the space above the frame 2 via the waist oil hole 4*k* provided at an upper position of the rotor shaft 4, and is fed back to the oil sump 104 via the oil return holes 1*e* provided in the outer periphery of the cylinder 1.

(Behaviors of First Vane 5 and Second Vane 6 at Abnormal Increase in Pressure of Gas Refrigerant)

Figure 9:
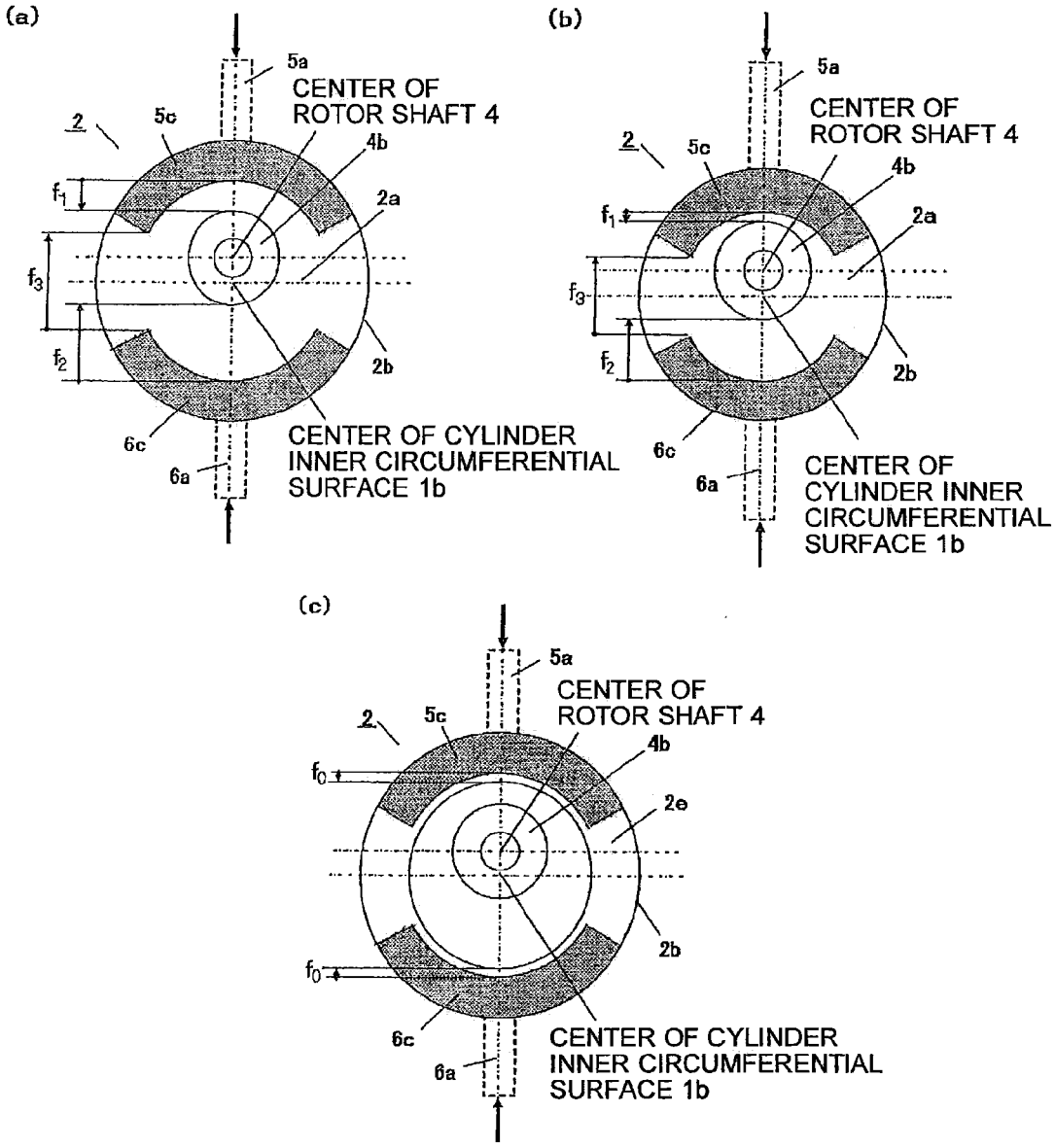
FIG. 9(*a*) to FIG. 9(*c*) include sectional views of the vane compressor 200 according to Embodiment 1 of the present invention each taken along line J-J illustrated in FIG. 4, the sectional views being enlarged views of one of the diagrams in FIG. 7 that illustrates the angle of rotation of 0 degrees.

FIG. 9(*a*) to FIG. 9(*c*) include sectional views of the vane compressor 200 according to Embodiment 1 of the present invention each taken along line J-J illustrated in FIG. 4, the sectional views being enlarged views of one of the diagrams in FIG. 7 that illustrates the angle of rotation of 0 degrees. FIGS. 9(*a*) and 9(*b*) illustrate cases in each of which the recess 2*a* has no level difference, that is, the recess 2*a* does not have the groove 2*e*. FIG. 9(*c*) illustrates Embodiment 1. Referring to FIG. 9(*a*) to FIG. 9(*c*), how the first vane 5 and the second vane 6 behave if the pressure in the suction chamber 9, the intermediate chamber 10, or the compression chamber 11 has increased abnormally as a result of an event such as the compression of the liquid refrigerant will now be described.

First, in FIG. 9(*a*), if the pressure in the compression chamber 11 increases abnormally, the pressure difference from the vane relief sections 4*f* and 4*g* causes the first vane 5 and the second vane 6 to be pushed toward the center of the cylinder inner circumferential surface 1*b* as indicated by arrows. If the force that pushes the first vane 5 and the second vane 6 toward the center of the cylinder inner circumferential surface 1*b* becomes larger than the centrifugal force acting on the first vane 5 and the second vane 6, the first vane 5 and the second vane 6 are pushed and travel toward the center of the cylinder inner circumferential surface 1*b*. In this case, the first vane 5 travels by a distance f1 to a position where the vane aligner 5*c* comes into contact with the rotating shaft portion 4*b* of the rotor shaft 4. Meanwhile, the second vane 6 travels by the shorter one of a distance f2, to a position where the vane aligner 6*c* comes into contact with the rotating shaft portion 4*b* of the rotor shaft 4, and a distance f3−f1, to a position where the vane aligner 6*c* comes into contact with the vane aligner 5*c* by the circumferential-direction ends thereof. In either case, the length of travel of the second vane 6 is longer than the length of travel of the first vane 5.

In FIG. 9(*b*), the diameter of the vane aligner bearing section 2*b* is reduced so that the above lengths of travel are reduced. In this manner, the distance f1 corresponding to the length of travel of the vane aligner 5*c* is reduced. Nevertheless, the distance f2 or the distance f3−f1 corresponding to the length of travel of the second vane 6 is much larger than the distance f1 corresponding to the length of travel of the first vane 5, for certain. Accordingly, the second vane 6 that travels a long distance may delay returning to the initial position, or, if the force of inertia acting on the second vane 6 increases, the vane aligner 6*c* may collide with the rotating shaft portion 4*b* of the rotor shaft 4 or the vane aligner 5*c* with a large force, leading to damage.

Next, referring to FIG. 9(*c*), the behaviors of the first vane 5 and the second vane 6 according to Embodiment 1 will be described. In FIG. 9(*c*), if the pressure in the compression chamber 11 increases abnormally and the force that pushes the first vane 5 and the second vane 6 toward the center of the cylinder inner circumferential surface 1*b* becomes larger than the centrifugal force acting on the first vane 5 and the second vane 6, the first vane 5 and the second vane 6 are pushed and travel toward the center of the cylinder inner circumferential surface 1*b*. Then, the vane aligners 5*c* and 6*c* come into contact with the inner perimeter of the groove 2*e*, whereby the traveling is prevented. In this case, a difference f0 between the groove width of the groove 2*e* and the radial-direction width of each of the vane aligners 5*c* and 6*c* corresponds to the length of travel of a corresponding one of the first vane 5 and the second vane 6. While FIG. 9 illustrates the cases in each of which the rotor shaft 4 is at the angle of rotation of 0 degrees, the length of travel of each of the first vane 5 and the second vane 6 also corresponds to the difference f0 at the other angles of rotation. Hence, if the difference f0 is set to an appropriate value, there is no chance that the first vane 5 and the second vane 6 may delay returning to the respective initial positions and that the force of contact between each of the vane aligners 5*c* and 6*c* and the groove 2*e* may become large. Therefore, the occurrence of damage to the first vane 5 and the second vane 6 is suppressed. The above behaviors of the vane aligners 5*c* and 6*c* in the groove 2*e* also apply to the vane aligners 5*d* and 6*d* in the groove 3*e*.

While the above description concerns a case where the pressure in the compression chamber 11 has increased abnormally, the first vane 5 and the second vane 6 behave in the same manner if the pressure in the suction chamber 9 or the intermediate chamber 10 has increased abnormally.

(Advantageous Effects of Embodiment 1)

As described above, providing a predetermined appropriate gap δ between the cylinder inner circumferential surface 1*b* and each of the vane tips 5*b* and 6*b* such that the relationship of Expression (1) given above holds suppresses the leakage of the refrigerant at the vane tips 5*b* and 6*b*, the reduction in the compressor efficiency due to an increase in the mechanical loss, and the wear of the vane tips 5*b* and 6*b*.

Furthermore, since the radius of curvature of the arc at each of the vane tip 5*b* of the first vane 5 and the vane tip 6*b* of the second vane 6 is substantially the same as the radius of curvature of the cylinder inner circumferential surface 1*b*, a state of hydrodynamic lubrication is produced between the cylinder inner circumferential surface 1*b* and each of the vane tips 5*b* and 6*b*, whereby the sliding resistance is reduced, and the mechanical loss is thus reduced.

Furthermore, the radial-direction width of the arc of each of the vane aligners 5*c* and 6*c* is smaller than the groove width of the groove 2*e*, and the radial-direction width of the arc of each of the vane aligners 5*d* and 6*d* is smaller than the groove width of the groove 3*e*, whereby the difference between the widths is set to a predetermined appropriate value. Here, if the pressure in the suction chamber 9, the intermediate chamber 10, or the compression chamber 11 has increased abnormally and the first vane 5 and the second vane 6 are pushed and travel toward the center of the cylinder inner circumferential surface 1*b*, the vane aligners 5*c* and 6*c* come into contact with the inner perimeter of the groove 2*e* while the vane aligners 5*d* and 6*d* come into contact with the inner perimeter of the groove 3*e*, whereby the traveling is prevented. Hence, there is no chance that the first vane 5 and the second vane 6 may delay returning to the respective initial positions and that the force of contact between each of the vane aligners 5*c* and 6*c* and the groove 2*e* and between each of the vane aligners 5*d* and 6*d* and the groove 3*e* may become large. Therefore, the occurrence of damage to the first vane 5 and the second vane 6 is suppressed, and high reliability is provided.

In Embodiment 1, the recesses 2*a* and 3*a* have level differences by having the respective grooves 2*e* and 3*e*, and the first vane 5 and the second vane 6 come into contact with the inner perimeters of the respective grooves 2*e* and 3*e*. Therefore, the force acting on the first vane 5 and the second vane 6 at the contact is shared between the grooves 2*e* and 3*e*. The present invention is not limited to such a configuration. As long as the force acting on the first vane 5 and the second vane 6 at the contact is received by either of the grooves 2*e* and 3*e*, only one of the grooves 2*e* and 3*e* may be provided.

While the above description concerns a case where the recesses 2*a* and 3*a* have level differences as the respective grooves 2*e* and 3*e* so as to prevent the first vane 5 and the second vane 6 from traveling toward the cylinder inner circumferential surface 1*b*, the present invention is not limited to such a case. As long as the first vane 5 and the second vane 6 are prevented from traveling toward the center of the cylinder inner circumferential surface 1*b*, the grooves 2*e* and 3*e* may be replaced with any other stoppers.

Furthermore, a mechanism that allows the vanes (the first vane 5 and the second vane 6) necessary for performing the compressing operation to rotate about the center of the cylinder inner circumferential surface 1*b* such that the line normal to the arc at each of the vane tips 5*b* and 6*b* and the line normal to the cylinder inner circumferential surface 1*b* always substantially coincide with each other is provided as an integral body including the rotor portion 4*a* and the rotating shaft portions 4*b* and 4*c*. Hence, the rotating shaft portions 4*b* and 4*c* can be each supported with a small diameter. Accordingly, the loss due to sliding on the bearings is reduced, the accuracy in the outside diameter and the center of rotation of the rotor portion 4*a* is increased, and the loss due to leakage is reduced with a reduced gap provided between the rotor portion 4*a* and the cylinder inner circumferential surface 1*b*.

While Embodiment 1 concerns a case where two vanes, which are the first vane 5 and the second vane 6, are provided to the rotor portion 4*a* of the rotor shaft 4, the present invention is not limited to such a case. One vane or three or more vanes may be provided.

Embodiment 2

A vane compressor 200 according to Embodiment 2 will now be described, focusing on differences from the vane compressor 200 according to Embodiment 1.

(Configuration of Vane Compressor 200)

Figure 10:
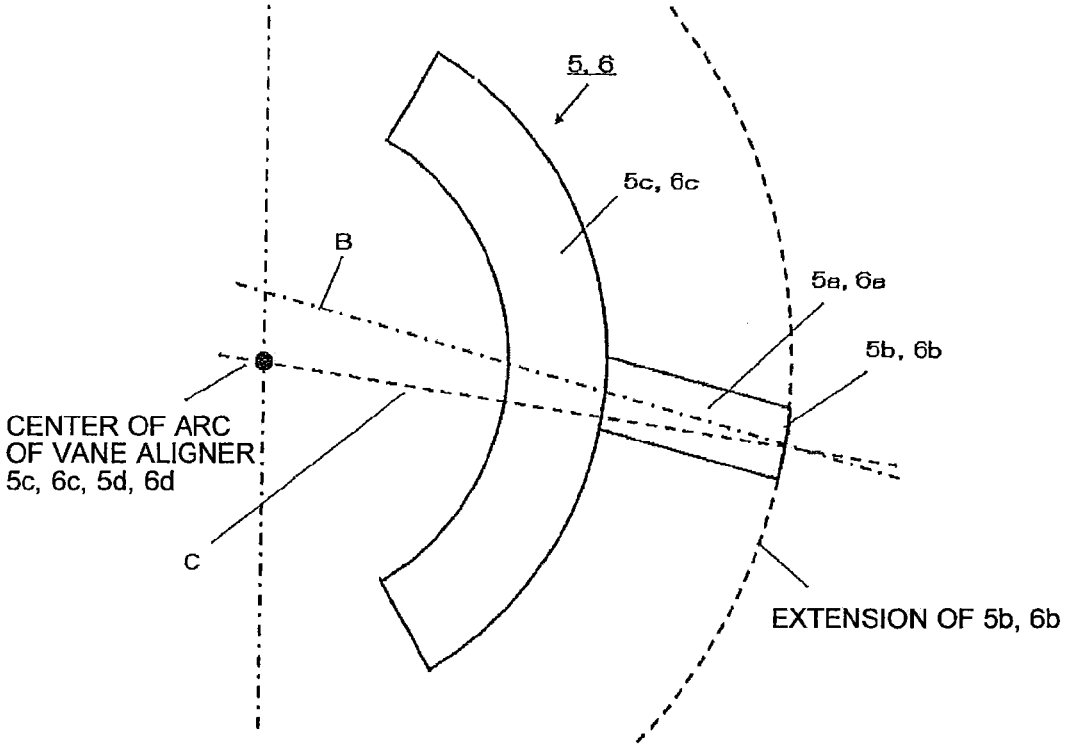
FIG. 10 is a plan view illustrating a first vane 5 or a second vane 6 of a vane compressor 200 according to Embodiment 2 of the present invention.
Figure 11:
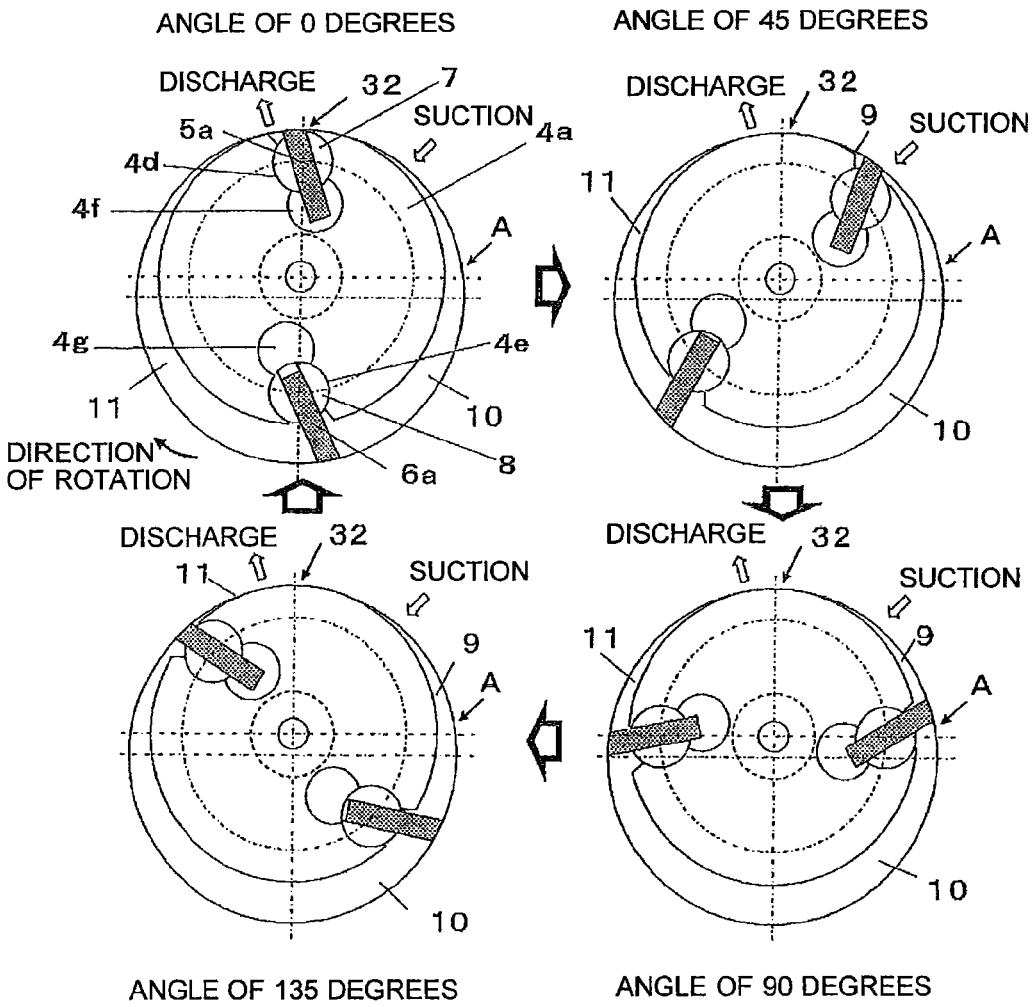
FIG. 11 includes diagrams illustrating a compressing operation performed by the vane compressor 200 according to Embodiment 2 of the present invention.

FIG. 10 is a plan view illustrating a first vane 5 or a second vane 6 of the vane compressor 200 according to Embodiment 2 of the present invention. FIG. 11 includes diagrams illustrating a compressing operation performed by the vane compressor 200.

As illustrated in FIG. 10, reference character B denotes a line extending in the longitudinal direction of a vane 5*a* or 6*a*, and reference character C denotes a line normal to the arc at a vane tip 5*b* or 6*b*. That is, the vane 5*a* or 6*a* is at an angle with respect to the vane aligners 5*c* and 5*d* or 6*c* and 6*d* in such a manner as to extend in the direction B. Furthermore, the line C normal to the arc at the vane tip 5*b* or 6*b* is at an angle with respect to the vane longitudinal direction B and passes through the center of the arc of the vane aligners 5*c* and 5*d* or 6*c* and 6*d*.

Furthermore, in Embodiment 2, the centers of the rotor portion 4*a* and the bush holding sections 4*d* and 4*e* are aligned on a substantially straight line. As illustrated in the diagram included in FIG. 11 illustrating "the angle of 0 degrees," the vane relief section 4*f* is provided slightly on the right side with respect to the straight line, whereas the vane relief section 4*g* is provided slightly on the left side with respect to the straight line.

(Compressing Operation of Vane Compressor 200)

In the above configuration also, a compressing operation is performed in a state where the line normal to the arc at each of the vane tips 5*b* and 6*b* and the line normal to the cylinder inner circumferential surface 1*b* always substantially coincide with each other, as in Embodiment 1 illustrated in FIG. 6. Hence, a very small gap is always provided between the cylinder inner circumferential surface 1*b* and each of the vane tips 5*b* and 6*b*, allowing the vane 5 and the vane 6 to rotate in a non-contact state.

(Advantageous Effects of Embodiment 2)

In Embodiment 2 also, if the recess 2*a* of the frame 2 and the recess 3*a* of the cylinder head 3 have level differences as the respective grooves 2*e* and 3*e*, the behaviors of the first vane 5 and the second vane 6 at an abnormal increase in the pressure in the suction chamber 9, the intermediate chamber 10, or the compression chamber 11 are the same as those in Embodiment 1, producing substantially the same effect as in Embodiment 1. The other effects produced in Embodiment 1 are also produced in Embodiment 2.

Embodiment 3

A vane compressor 200 according to Embodiment 3 will now be described, focusing on differences from the vane compressor 200 according to Embodiment 1.

(Configuration of Vane Compressor 200)

Figure 12:
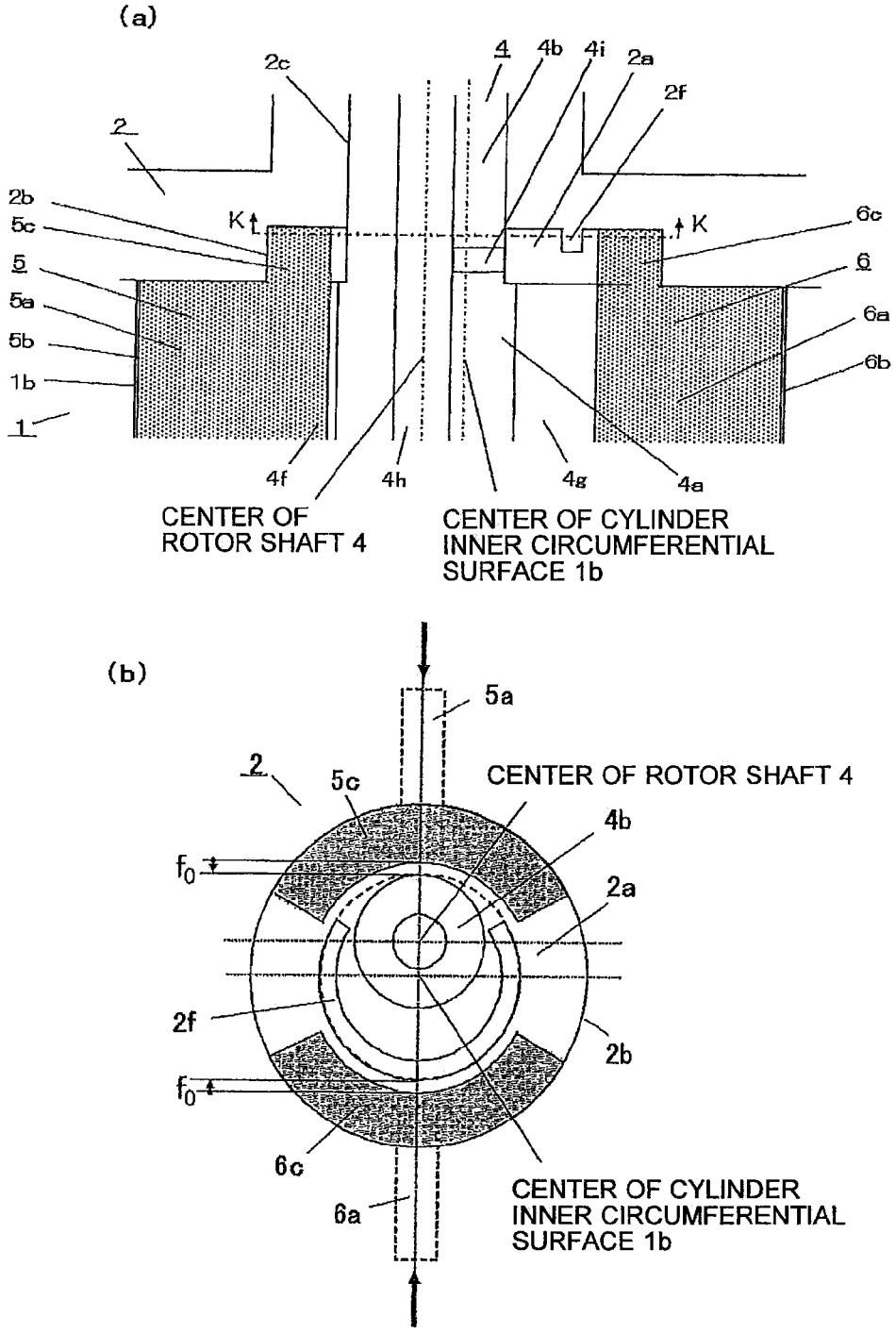
FIG. 12(*a*) and FIG. 12(*b*) include diagrams each illustrating a vane aligner bearing section 2*b* and associated elements included in a vane compressor 200 according to Embodiment 3 of the present invention FIG. 13(*a*) and FIG. 13(*b*) include diagrams each illustrating a vane aligner bearing section 2*b* and associated elements included in a vane compressor 200 according to Embodiment 4 of the present invention.

FIG. 12(*a*) and FIG. 12(*b*) include diagrams each illustrating a vane aligner bearing section 2*b* and associated elements included in the vane compressor 200 according to Embodiment 3 of the present invention. FIG. 12(*a*) is a longitudinal sectional view illustrating the vane aligner bearing section 2*b* and associated elements. FIG. 12(*b*) is a sectional view taken along line K-K illustrated in FIG. 12(*a*).

As illustrated in FIG. 12(*a*) and FIG. 12(*b*), a stopper 2*f* shaped as a part of a ring is provided in the recess 2*a* and integrally with the frame 2. The stopper 2*f* is substantially concentric with respect to the vane aligner bearing section 2*b* whose outer circumferential surface corresponds to the outer circumferential surface of the recess 2*a*. As illustrated in FIG. 12(*a*), the stopper 2*f* has a ring-like shape with a part thereof that may interfere with the rotating shaft portion 4*b* being cut off. The radius of curvature of the outer circumferential surface of the stopper 2*f* represented by the broken line in FIG. 12(*b*) is substantially the same as the maximum distance between the outer circumference of the rotating shaft portion 4*b* and the center of the cylinder inner circumferential surface 1*b*.

The radius of curvature of the outer circumferential surface of the stopper 2*f* is not necessarily exactly the same as the above maximum distance.

(Behaviors of First Vane 5 and Second Vane 6 at Abnormal Increase in Pressure of Gas Refrigerant)

Referring to FIG. 12(*a*) and FIG. 12(*b*), how the first vane 5 and the second vane 6 behave if the pressure in the suction chamber 9, the intermediate chamber 10, or the compression chamber 11 has increased abnormally will be now described.

If the pressure in the compression chamber 11 has increased abnormally and the force that pushes the first vane 5 and the second vane 6 toward the center of the cylinder inner circumferential surface 1*b* becomes larger than the centrifugal force acting on the first vane 5 and the second vane 6, the first vane 5 and the second vane 6 are pushed and travel toward the center of the cylinder inner circumferential surface 1*b*. Here, let the difference between the radius of curvature of the inner circumferential surface of each of the vane aligners 5*c* and 6*c* and the radius of curvature of the outer circumferential surface of the stopper 2*f* be f0. The radius of curvature of the outer circumferential surface of the stopper 2*f* is set so as to be substantially the same as the maximum distance between the outer circumference of the rotating shaft portion 4*b* and the center of the cylinder inner circumferential surface 1*b*. Hence, the vane aligner 5*c* of the first vane 5 travels toward the center of the cylinder inner circumferential surface 1*b* by the difference f0 and comes into contact with the stopper 2*f* or the outer circumference of the rotating shaft portion 4*b*. Meanwhile, the vane aligner 6*c* of the second vane 6 travels toward the center of the cylinder inner circumferential surface 1*b* by the difference f0 and comes into contact with the stopper 2*f*. Accordingly, the first vane 5 and the second vane 6 always travel by the same length (the difference f0). If the difference f0 corresponding to the length of travel is set to an appropriate value, effects that are the substantially the same as those produced in Embodiment 1 are produced.

While the above description concerns a case where the pressure in the compression chamber 11 has increased abnormally, the first vane 5 and the second vane 6 behave in the same manner if the pressure in the suction chamber 9 or the intermediate chamber 10 has increased abnormally.

(Advantageous Effects of Embodiment 3)

In Embodiment 3, the first vane 5 or the second vane 6 may come into contact with the rotating shaft portions 4*b* and 4*c*. Therefore, if the lengths of travel of the first vane 5 and the second vane 6 each corresponding to the difference f0 are the same as each other, the diameters of the vane aligner bearing sections 2*b* and 3*b* can be made smaller than in Embodiment 1 where the first vane 5 or the second vane 6 comes into contact with the inner circumferential surface of the grooves 2*e* and 3*e*. If the diameters of the vane aligner bearing sections 2*b* and 3*b* can be made smaller, the loss due to sliding on the vane aligner bearing sections 2*b* and 3*b* can be reduced. Therefore, Embodiment 3 produces an effect of more reduction in the loss than in Embodiment 1.

While Embodiment 3 concerns a case where only the stopper 2*f* is provided, a stopper 3*f* (not illustrated) shaped as a part of a ring as with the stopper 2*f* may also be provided in the recess 3*a* of the cylinder head 3 and integrally with the cylinder head 3. In such a case, the force acting on the first vane 5 or the second vane 6 is shared between the two stoppers 2*f* and 3*f*, whereby the traveling of the first vane 5 or the second vane 6 is more assuredly prevented.

In Embodiment 3, the radius of curvature of the outer circumferential surface of the stopper 2*f* is set so as to be substantially the same as the maximum distance between the outer circumference of the rotating shaft portion 4*b* and the center of the cylinder inner circumferential surface 1*b* as illustrated in FIG. 12(*a*) and FIG. 12(*b*). The present invention is not limited to such a case. Specifically, to prevent the vane aligners 5*c* and 6*c* from coming into contact with the rotating shaft portion 4*b*, it is only necessary to make the radius of curvature of the outer circumferential surface of the stopper 2*f* slightly larger than the maximum distance between the outer circumference of the rotating shaft portion 4*b* and the center of the cylinder inner circumferential surface 1*b*. Thus, the first vane 5 and the second vane 6 are allowed to come into contact with only the stopper 2*f*.

Embodiment 4

A vane compressor 200 according to Embodiment 4 will now be described, focusing on differences from the vane compressor 200 according to Embodiment 3.

(Configuration of Vane Compressor 200)

Figure 13:
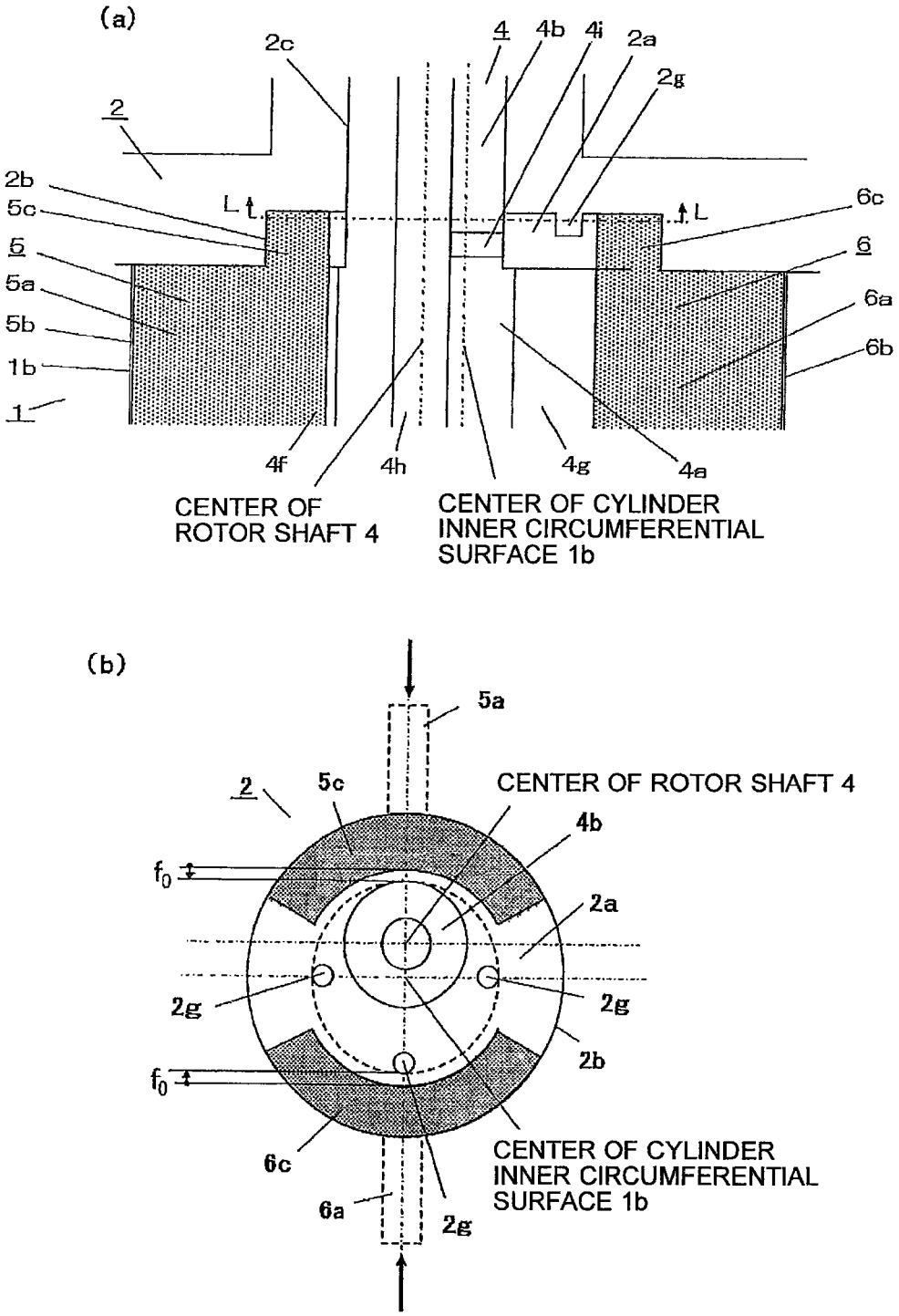

FIG. 13(*a*) and FIG. 13 (*b*) include diagrams each illustrating a vane aligner bearing section 2*b* and associated elements included in the vane compressor 200 according to Embodiment 4 of the present invention. FIG. 13(*a*) is a longitudinal sectional view illustrating the vane aligner bearing section 2*b* and associated elements. FIG. 13(*b*) is a sectional view taken along line L-L illustrated in FIG. 13(*a*).

In Embodiment 4 illustrated in FIG. 13(*a*) and FIG. 13(*b*), the stopper 2*f* according to Embodiment 2 that is shaped as a part of a ring is replaced with a plurality (three in FIG. 13) of columnar stoppers or columnar members 2*g* provided in the recess 2*a* and integrally with the frame 2. The maximum distance between the outer circumference of each of the columnar stoppers 2*g* and the center of the cylinder inner circumferential surface 1*b* is set so as to be substantially the same as the maximum distance between the outer circumference of the rotating shaft portion 4*b* and the center of the cylinder inner circumferential surface 1*b* as illustrated in FIG. 13(*b*). The columnar stoppers 2*g* and the rotating shaft portion 4*b* are arranged at substantially regular intervals.

The maximum distance between the outer circumference of each of the columnar stoppers 2*g* and the center of the cylinder inner circumferential surface 1*b* is not necessarily exactly the same as the maximum distance between the outer circumference of the rotating shaft portion 4*b* and the center of the cylinder inner circumferential surface 1*b*.

(Behaviors of First Vane 5 and Second Vane 6 at Abnormal Increase in Pressure of Gas Refrigerant)

Next, referring to FIG. 13(*a*) and FIG. 13(*b*), how the first vane 5 and the second vane 6 behave if the pressure in the suction chamber 9, the intermediate chamber 10, or the compression chamber 11 has increased abnormally will be described.

In the configuration according to Embodiment 4 illustrated in FIG. 13(*a*) and FIG. 13(*b*), as in Embodiment 3, if the pressure in the compression chamber 11 has increased abnormally and the first vane 5 and the second vane 6 travel toward the center of the cylinder inner circumferential surface 1*b*, the vane aligner 5*c* of the first vane 5 comes into contact with the stoppers 2*g* or the rotating shaft portion 4*b* while the vane aligner 6*c* of the second vane 6 comes into contact with the stoppers 2*g*, whereby the traveling is prevented. Here, let the difference between the radius of curvature of the inner circumferential surface of each of the vane aligners 5*c* and 6*c* and the distance between the outer circumference of each of the stoppers 2*g* and the center of the cylinder inner circumferential surface 1*b* be f0. The difference f0 corresponds to the length of travel of each of the first vane 5 and the second vane 6. If the difference f0 corresponding to the length of travel is set to an appropriate value, substantially the same effects as in Embodiment 3 are produced.

While Embodiment 4 employs only the stoppers 2g, a plurality of columnar stoppers 3g (not illustrated) that are the same as the stoppers 2g may also be provided in the recess 3a of the cylinder head 3 and integrally with the cylinder head 3. Thus, the force acting on the first vane 5 or the second vane 6 is shared among the stoppers 2g and 3g. Therefore, the traveling of the first vane 5 or the second vane 6 is more assuredly prevented.

In Embodiment 4 also, to prevent the vane aligners 5c and 6c from coming into contact with the rotating shaft portion 4b, the maximum distance between the outer circumference of each of the stoppers 2g and the center of the cylinder inner circumferential surface 1b only needs to be made slightly larger than the maximum distance between the outer circumference of the rotating shaft portion 4b and the center of the cylinder inner circumferential surface 1b. Thus, the first vane 5 and the second vane 6 are allowed to come into contact with only the stoppers 2g.

While the above description concerns a case where three columnar stoppers 2g are provided, the number of stoppers 2g is not necessarily three and may be two or four or more, as long as the first vane 5 and the second vane 6 that have moved assuredly come into contact with any of the stoppers 2g. Furthermore, while the above description concerns a case where the columnar stoppers 2g and the rotating shaft portion 4b are arranged at substantially regular intervals, they are not necessarily arranged at regular intervals as long as the first vane 5 and the second vane 6 that have moved assuredly come into contact with any of the stoppers 2g. Furthermore, while the above embodiment concerns a case where the stoppers 2g each have a columnar shape, the stoppers 2g do not each necessarily have a columnar shape. For example, the stoppers 2g may each have any shape such as an oval shape, as long as the lengths of travel of the first vane 5 and the second vane 6 can be set appropriately.

While Embodiments 1 to 4 each concern a case where the oil pump 31 utilizing the centrifugal force of the rotor shaft 4 is employed, the oil pump 31 may be of any type. For example, a positive-displacement pump disclosed by Japanese Unexamined Patent Application Publication No. 2009-62820 may be employed as the oil pump 31.

REFERENCE SIGNS LIST

1 cylinder, 1a suction port, 1b cylinder inner circumferential surface, 1c notch, 1d discharge port, 1e oil return hole, 1f through section, 2 frame, 2a recess, 2b vane aligner bearing section, 2c main bearing section, 2d discharge port, 2e groove, 2f, 2g stopper, 3 cylinder head, 3a recess, 3b vane aligner bearing section, 3c main bearing section, 3e groove, 3f, 3g stopper, 4 rotor shaft, 4a rotor portion, 4b, 4c rotating shaft portion, 4d, 4e bush holding section, 4f, 4g vane relief section, 4h to 4j oil supply path, 4k waist oil hole, 5 first vane, 5a vane, 5b vane tip, 5c, 5d vane aligner, 6 second vane, 6a vane, 6b vane tip, 6c, 6d vane aligner, 7 bush, 7a bush center, 8 bush, 8a bush center, 9 suction chamber, 10 intermediate chamber, 11 compression chamber, 21 stator, rotor, 23 glass terminal, 24 discharge pipe, 25 refrigerating machine oil, 26 suction pipe, 27 discharge valve, 28 discharge valve guide, 31 oil pump, 32 closest point, 101 compressing element, 102 electrical element, 103 sealing container, 104 oil sump, 200 vane compressor

The invention claimed is:

1. A vane compressor comprising:

a compressing element that compresses a refrigerant, the compressing element including:

a cylinder having a cylindrical inner circumferential surface, a rotor shaft provided in the cylinder and including a cylindrical rotor portion and a rotating shaft portion, the rotor portion being configured to rotate about an axis of rotation displaced from a central axis of the inner circumferential surface of the cylinder by a predetermined distance, the rotating shaft portion being configured to transmit a rotational force from an outside to the rotor portion, a frame that closes one of openings defined by the inner circumferential surface of the cylinder and supports the rotating shaft portion by a main bearing section, a cylinder head that closes other of the openings defined by the inner circumferential surface of the cylinder and supports the rotating shaft portion by a main bearing section, and at least one vane provided in the rotor portion, the at least one vane having a tip projects from the rotor portion and having a shape of an arc that is convex outward; and a vane support that supports the vane such that the refrigerant is compressed in a space defined by the vane, an outer circumference of the rotor portion, and the inner circumference surface of the cylinder and such that a line normal to the arc at the tip of the vane and a line normal to the inner circumferential surface of the cylinder coincide with each other, the vane support supporting the vane such that the vane is swingable and movable with respect to the rotor portion, the vane support holding the vane such that a predetermined gap is provided between the tip of the vane and the inner circumferential surface of the cylinder in a state where the tip of the vane has moved by a maximum length toward the inner circumferential surface of the cylinder;

wherein the rotor shaft is an integral body including the rotor portion and the rotating shaft portion, wherein the vane includes a pair of vane aligners each shaped as a part of a ring, one of the vane aligners being provided on an end facet of the vane that is on a side nearer to the frame and on a part of the end facet that is nearer to a center of the rotor portion, the other vane aligner being provided on the end facet of the vane that is on a side nearer to the cylinder head and on a part of the end facet that is nearer to the center of the rotor portion, wherein the frame and the cylinder head each have a recess provided in an end facet that is nearer to the cylinder, the recess being concentric with respect to the inner circumferential surface of the cylinder, wherein the vane aligners are fitted in the recess and are supported by a vane aligner bearing section provided as an outer circumferential surface of the recess, wherein a stopper is provided in the recess of at least one of the frame and the cylinder head, the stopper prevents a corresponding one of the vane aligners from moving toward an inner side of the rotor portion, wherein the stopper is a member provided in the recess and being shaped as a part of a ring obtained by cutting off a part of the ring that interferes with the rotating shaft portion, the stopper having an outer circumferential surface that is concentric with respect to a corresponding one of the vane aligner bearing sections, and wherein the corresponding vane aligner is fitted between the outer circumferential surface of the stopper and the corresponding vane aligner bearing section.

2. The vane compressor of claim 1, wherein a radius of curvature of the outer circumferential surface of the stopper is the same as a maximum distance between an outer circumference of the rotating shaft portion and a center of the inner circumferential surface of the cylinder.

3. The vane compressor of claim 1, wherein a radius of curvature of the arc at the tip of the vane is the same as a radius of curvature of the inner circumferential surface of the cylinder.

4. A vane compressor comprising:

a compressing element that compresses a refrigerant, the compressing element including:

a cylinder having a cylindrical inner circumferential surface, a rotor shaft provided in the cylinder and including a cylindrical rotor portion and a rotating shaft portion, the rotor portion being configured to rotate about an axis of rotation displaced from a central axis of the inner circumferential surface of the cylinder by a predetermined distance, the rotating shaft portion being configured to transmit a rotational force from an outside to the rotor portion, a frame that closes one of openings defined by the inner circumferential surface of the cylinder and supports the rotating shaft portion by a main bearing section, a cylinder head that closes other of the openings defined by the inner circumferential surface of the cylinder and supports the rotating shaft portion by a main bearing section, and at least one vane provided in the rotor portion, the at least one vane having a tip projects from the rotor portion and having a shape of an arc that is convex outward; and a vane support that supports the vane such that the refrigerant is compressed in a space defined by the vane, an outer circumference of the rotor portion, and the inner circumference surface of the cylinder and such that a line normal to the arc at the tip of the vane and a line normal to the inner circumferential surface of the cylinder coincide with each other, the vane support supporting the vane such that the vane is swingable and movable with respect to the rotor portion, the vane support holding the vane such that a predetermined gap is provided between the tip of the vane and the inner circumferential surface of the cylinder in a state where the tip of the vane has moved by a maximum length toward the inner circumferential surface of the cylinder;

wherein the rotor shaft is an integral body including the rotor portion and the rotating shaft portion, wherein the vane includes a pair of vane aligners each shaped as a part of a ring, one of the vane aligners being provided on an end facet of the vane that is on a side nearer to the frame and on a part of the end facet that is nearer to a center of the rotor portion, the other vane aligner being provided on the end facet of the vane that is on a side nearer to the cylinder head and on a part of the end facet that is nearer to the center of the rotor portion, wherein the frame and the cylinder head each have a recess provided in an end facet that is nearer to the cylinder, the recess being concentric with respect to the inner circumferential surface of the cylinder, wherein the vane aligners are fitted in the recess and are supported by a vane aligner bearing section provided as an outer circumferential surface of the recess, wherein a stopper is provided in the recess of at least one of the frame and the cylinder head, the stopper prevents a corresponding one of the vane aligners from moving toward an inner side of the rotor portion, wherein the stopper includes a plurality of columnar members provided in the recess such that central axes of the columnar members reside on a circle that is concentric with respect to a corresponding one of the vane aligner bearing sections, and wherein the corresponding vane aligner is fitted between the circle and the corresponding vane aligner bearing section.

5. The vane compressor of claim 4, wherein a maximum distance between an outer circumference of each of the columnar members and the center of the inner circumferential surface of the cylinder is the same as a maximum distance between an outer circumference of the rotating shaft portion and the center of the inner circumferential surface of the cylinder.

6. The vane compressor of claim 4, wherein a radius of curvature of the arc at the tip of the vane is the same as a radius of curvature of the inner circumferential surface of the cylinder.

* * * * *